US010600278B2

(12) United States Patent
Minor

(10) Patent No.: US 10,600,278 B2
(45) Date of Patent: Mar. 24, 2020

(54) REEL-BASED WAGERING GAMES

(71) Applicant: King Show Games Inc., Minnetonka, MN (US)

(72) Inventor: Sara Minor, Golden Valley, MN (US)

( * ) Notice: Subject to any disclaimer, the term of this patent is extended or adjusted under 35 U.S.C. 154(b) by 0 days.

(21) Appl. No.: 16/162,021

(22) Filed: Oct. 16, 2018

(65) Prior Publication Data

US 2019/0114873 A1 Apr. 18, 2019

Related U.S. Application Data

(60) Provisional application No. 62/574,115, filed on Oct. 18, 2017.

(51) Int. Cl.
*G07F 17/32* (2006.01)

(52) U.S. Cl.
CPC ..... *G07F 17/3213* (2013.01); *G07F 17/3244* (2013.01); *G07F 17/3267* (2013.01)

(58) Field of Classification Search
USPC ..... 463/20
See application file for complete search history.

(56) References Cited

U.S. PATENT DOCUMENTS 6,413,162 B1 7/2002 Baerlocher et al.
6,896,615 B2 5/2005 Berman
6,896,617 B2 5/2005 Daly
7,108,602 B2 9/2006 Daly
7,128,647 B2 10/2006 Muir
7,160,187 B2 1/2007 Loose et al.
7,927,204 B2 4/2011 DeBrabander, Jr. et al.
8,662,991 B2 3/2014 Harari
8,840,457 B1 9/2014 Basallo et al.
9,070,259 B2 6/2015 Berman et al.
9,177,447 B2 11/2015 Zoltewicz et al.
9,177,448 B2 11/2015 Caputo et al.
9,214,067 B2 12/2015 Basallo et al.
9,361,765 B2 6/2016 Smalley
9,430,914 B2 8/2016 Delekta
9,530,282 B2 12/2016 Goldman et al.
9,875,618 B2 1/2018 SeLegue et al.
10,332,335 B2 6/2019 Halvorson et al.
2004/0048646 A1 3/2004 Visocnik
2004/0053683 A1* 3/2004 Hartl ..... G07F 17/32 463/25
2004/0077404 A1 4/2004 Schlottmann et al.
2004/0127282 A1 7/2004 Naobayashi
2004/0219969 A1 11/2004 Casey et al.
2005/0060050 A1 3/2005 Baerlocher
2005/0071023 A1 3/2005 Gilliland et al.
2006/0030387 A1 2/2006 Jackson
2006/0052152 A1 3/2006 Tedsen et al.
2006/0068873 A1 3/2006 Gomez
2007/0077978 A1* 4/2007 Walker ..... G07F 17/32 463/16
2009/0075721 A1* 3/2009 Pacey ..... G07F 17/3211 463/20
2009/0131145 A1 5/2009 Aoki et al.
(Continued)

*Primary Examiner* — Pierre E Elisca

(57) ABSTRACT

Reel-based wagering games comprise displaying a number of game reels; evaluating payout conditions associated with the number of game reels; based on evaluation of the payout conditions, displaying a bonus reel; and evaluating payout conditions associated with the number of game reels and the bonus reel.

20 Claims, 14 Drawing Sheets

(56) References Cited

U.S. PATENT DOCUMENTS

| | | | |
|---|---|---|---|
| 2009/0239631 | A1 | 9/2009 | Aoki et al. |
| 2011/0111824 | A1 | 5/2011 | Cuddy et al. |
| 2012/0122547 | A1 | 5/2012 | Aoki et al. |
| 2013/0102375 | A1 | 4/2013 | Aoki et al. |
| 2013/0252699 | A1 | 9/2013 | Nauman et al. |

* cited by examiner

REEL-BASED WAGERING GAMES

RELATED APPLICATION

This application claims priority under 35 U.S.C. § 119(e) to U.S. Provisional Patent Application No. 62/574,115, which is entitled "REEL-BASED WAGERING GAMES," was filed on Oct. 18, 2017, and the disclosure of which is incorporated by reference.

FIELD

The present disclosure relates to reel-based wagering games.

BACKGROUND

Casino games such as poker, slots, and craps have long been enjoyed for entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever-wider selection of new games when visiting casinos and other gaming venues. Playing new games adds to the excitement of "gaming." As is well known in the art and as used herein, the term "gaming" and "gaming devices" generally involves some form of wagering, in that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

Reel-based wagering games and associated methods and gaming apparatuses are disclosed. Examples of reel-based wagering games comprise displaying a number of game reels; evaluating payout conditions associated with the number of game reels; based on evaluation of the payout conditions, displaying a bonus reel; and evaluating payout conditions associated with the number of game reels and the bonus reel. In some examples, displaying the bonus reel comprises visually shifting the bonus reel into a left-most column of a game grid in a left to right paying game or visually shifting the bonus reel into a right-most column of the game grid in a right to left paying game.

DESCRIPTION

Figure 1:
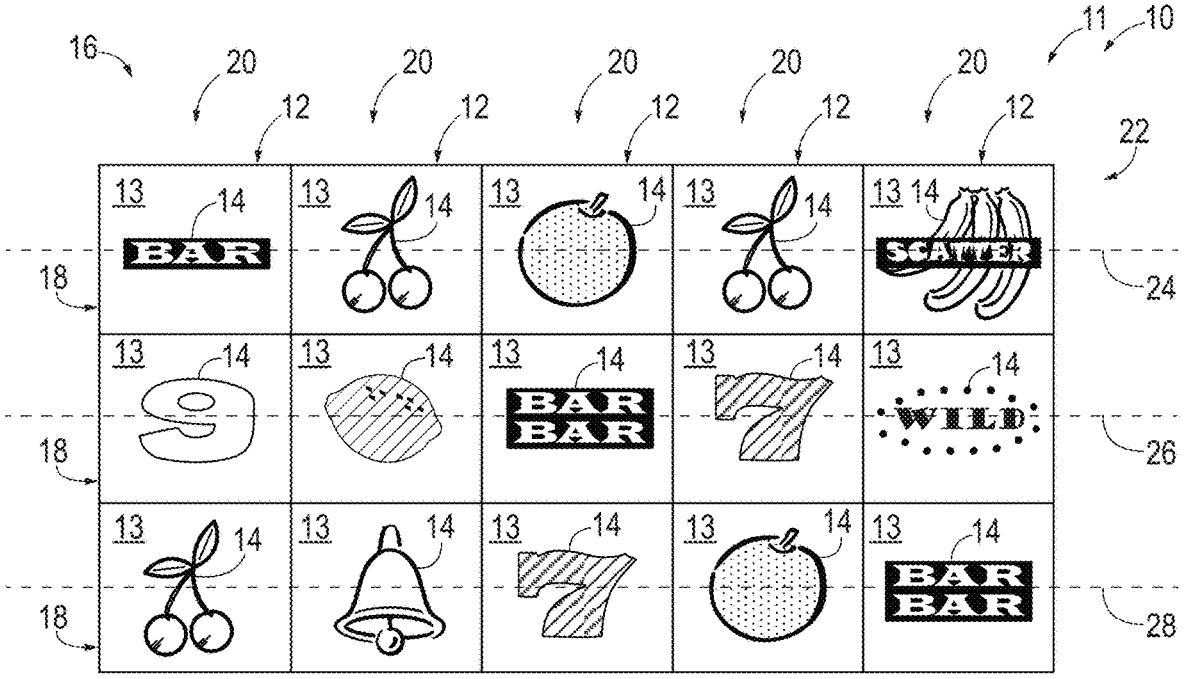
FIG. 1 is a representation of example reel-based wagering games having five reels with multiple paylines.
Figure 2:
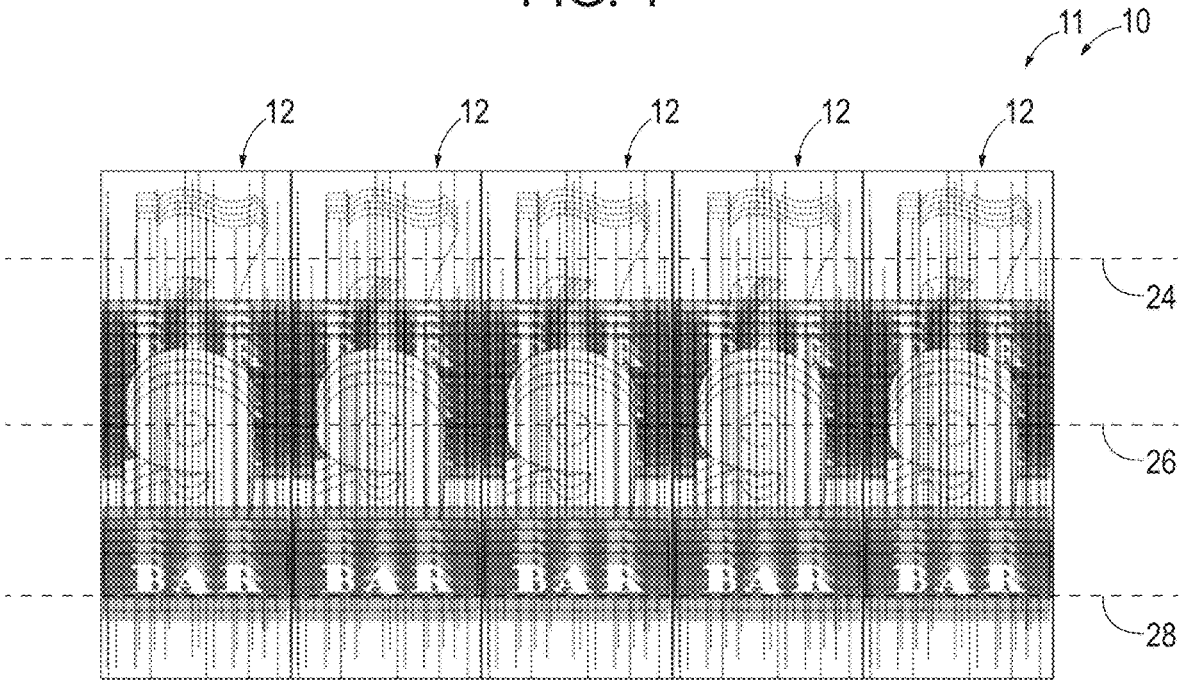
FIG. 2 is a representation of an example game of FIG. 1, with all five reels depicted in a changing state.
Figure 3:
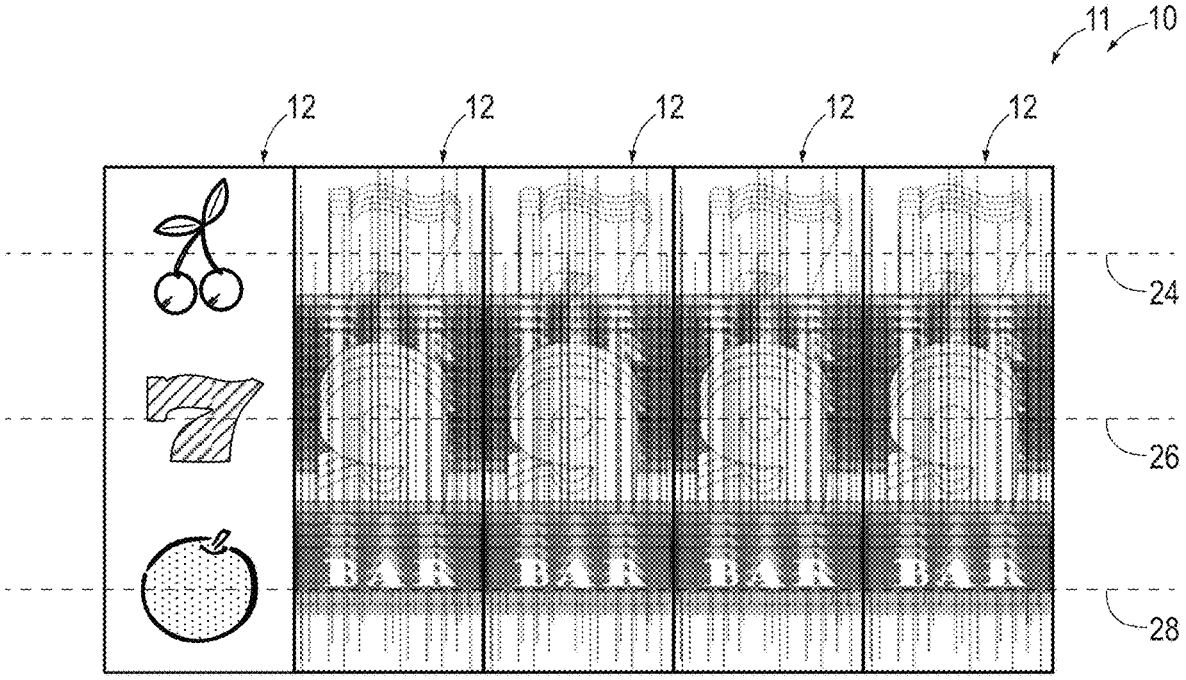
FIG. 3 is a representation of an example game of FIG. 1 in sequence with FIG. 2, with the left-most reel depicted in a stopped state.
Figure 4:
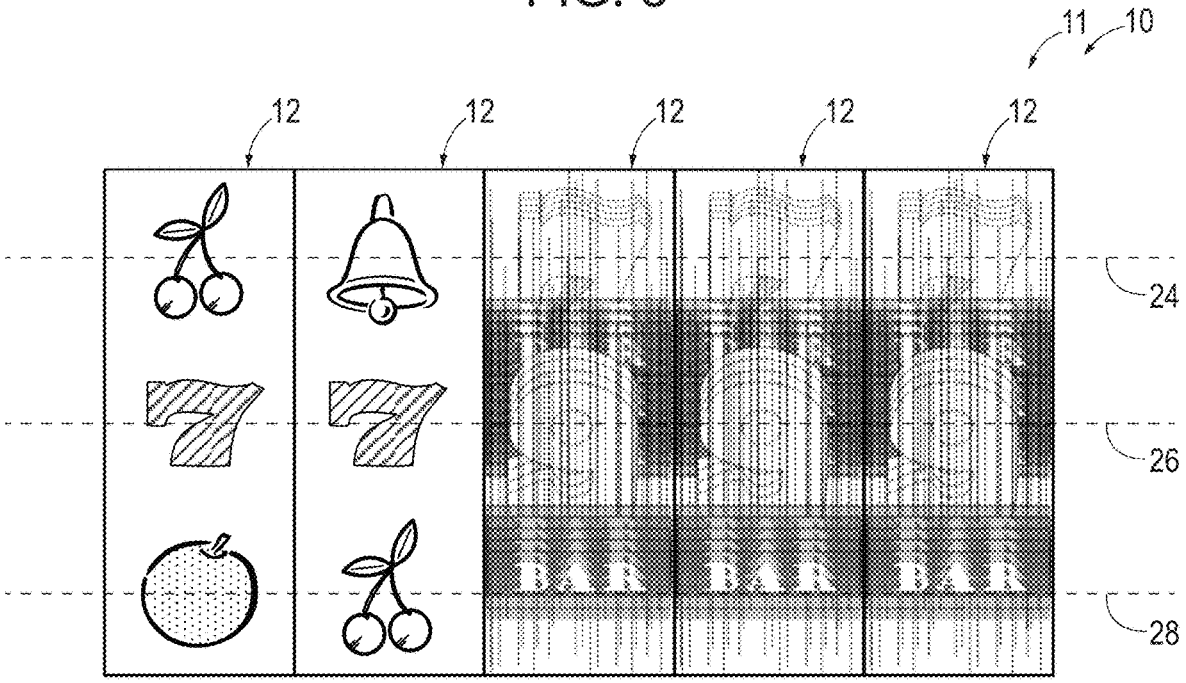
FIG. 4 is a representation of an example game of FIG. 1 in sequence with FIGS. 2-3, with the two left-most reels depicted in stopped states and leading to a payout condition.

In the following description of various exemplary embodiments, reference is made to the accompanying drawings which form a part hereof, and in which are shown by way of illustration representative embodiments in which the features described herein may be practiced. It is to be understood that other embodiments may be utilized, as structural and operational changes may be made without departing from the scope of the disclosure.

In the description that follows, the term "reels" and similar mechanically descriptive language may be used to describe various apparatus presentation features, as well as various actions occurring to those objects (e.g., "spin" and "stop"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as reels and the like may be simulated on a display in order to provide a familiar and satisfying experience that emulates the behavior of mechanical objects, as well as emulating actions that occur in non-computerized games (e.g., spinning and stopping reels). Further, a computerized version may provide the look of mechanical equivalents but may be generally randomized in a different way. Thus, the term "reel," for example, is intended to describe both physical reels and emulation or simulations of physical reels and their behaviors using electronic apparatus.

In various embodiments, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing one symbol with another symbol. Generally, such comparisons can be performed via software by mapping numbers (or other data structures such as character strings) to the symbols and performing the comparisons on the numbers/data structures.

Generally, the games and methods disclosed herein provide a player with two or more opportunities to win a discrete play of a game. Such games may be referred to as providing "second chance" opportunities or bonus opportunities, and the like. The games and methods disclosed herein may be implemented as a single game, or part of a multi-part game. For example, the game features disclosed herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g., slot game) are provided for purposes of facilitating an understanding of the features described herein. However, the principles described herein are equally applicable to any game of chance where an outcome(s) is determined for use in the player's gaming activity.

Reel-based wagering games and corresponding game methods are disclosed herein, with the reel-based wagering games indicated in the figures at 10 and generally referred to herein as reel-based wagering games 10, or just games 10. Reel-based wagering games 10 additionally or alternatively may be referred to as slots, video slots, slot games, slot machines, reel-based slot machines, and so forth. Games 10 may include any number of reels 12, with any number of symbols 14 associated with the reels 12. The presentation, representation, or display of a game 10 may be described as including a grid 16 of symbol positions 13, including two or more rows 18 and two or more columns 20, with individual columns 20 corresponding to individual reels 12, and with the displayed symbols 14 shown in the symbol positions 13 representing a subset of the total symbols 14 associated with all of the reels 12. The reels 12 may be displayed as stopped reels, with only a subset of symbols associated with a given reel being displayed. Additionally, the reels 12 may be displayed as changing reels, with the symbols associated with a given reel moving, such as in connection with a spinning reel in mechanical examples, or simply as changing symbols, whether simulating a mechanical reel or representing random or other representation of symbols.

In mechanical examples, the game reels 12 may include physical reel strips where game symbols 14 are shown in images fixed on the reel strips. Virtual reel strips may be mapped to these physical reel positions shown on the reel strips to expand the range or diversity of game outcomes. In video slot examples, reel strips may be encoded in a memory or database, and virtual reels may be used for the game reels with images representing the data related to the reel strips. In other slot machine embodiments, each symbol position 13 on the grid 16 may be associated with an independent reel strip. In yet other slot machine embodiments, reels and/or reel strips may not be used at all in determining the symbols shown in the symbol positions 13 of the grid. For example, a symbol 14 may be randomly selected for each symbol position 13 within the grid 16, or the symbols 14 may be determined in part by game events occurring during game play, such as displayed elements in the symbol positions 13 being replaced by new game elements or symbols. Numerous variations are possible for implementing slot-type game play.

The example games 10 illustrated in FIGS. 1-23 have a default grid 16 representing three rows 18 of symbols 14 from five reels 12, resulting in a total of fifteen displayed symbols 14 when all five reels 12 are stopped, and are referred to herein as games 11; however, the features of example games 11 discussed herein may be applied to games 10 having any suitable size of default grid 16 with any number of rows 18 and/or any number of reels 12.

Payout schemes associated with slots may include evaluations of symbol combinations associated with line pays along paylines 22, scatter pays, multi-way pays, or other types of symbol combination evaluation methods. In slot games that utilize line pays, the line payout schemes are often associated with one or more paylines 22, where each payline 22 corresponds to a predetermined arrangement or combination associated with predetermined symbol positions 13 within a game's grid 16. To ascertain whether a payout condition exists for a given game outcome, the game symbols 14 within the symbol positions 13 associated with a particular payline 22 may be evaluated to determine if a symbol combination is present that matches an entry in a paytable with an associated award. Any number of paylines 22 may be utilized in a game 10 according to the present disclosure, and for simplicity, game 11 is schematically shown having three paylines 22. More specifically, with respect to example game 11, a payline 24 is associated with the upper row 18 of symbols 14, a payline 26 is associated with the middle row 18 of symbols 14, and a payline 28 is associated with lower row 18 of symbols 14.

Although embodiments of games 10 that utilize paylines 22 as part of their payout schemes are described below in detail, other embodiments may use different payout schemes while still benefitting from the concepts described herein. For example, in embodiments where a game 10 utilizes multi-way payout schemes, similar principles of beginning the symbol combination evaluations at different starting points among the respective game reels 12 may be used. Thus, while the below description focuses on embodiments that utilize payline evaluation payout schemes, multi-way or other payout schemes may use similar techniques and are contemplated, as well.

Historically, most reel-based wagering games evaluate symbol combinations starting at the left-most game reel and then proceeding to the right ("left to right paying games"), although other games may evaluate symbol combinations beginning on the right-most reel and then proceeding to the left ("right to left paying games") or evaluate both left to right and right to left ("both way paying games"). Although left to right paying game embodiments are described below in connection with example game 11, the described evaluation techniques similarly could be used for right to left paying game embodiments or both way paying game embodiments. Historically, for left to right paying games, the games generally only payout if the left-most stopped reel has at least one symbol that initiates or begins a symbol combination associated with an award in a pay table.

In addition, reel-based wagering games that either utilize paylines or multiway pays typically require a minimum number of sequential (i.e., directly adjacent) reels to have matching or winning symbols along a payline (or within each reel for a multi-way pay evaluation embodiment) (also referred to as "symbol combinations") to result in a payout (referred to herein as the "threshold number of reels"), with three sequential reels being a common threshold number of reels, but any number being within the scope of the disclosure. Although the above games are described with sequential or adjacent reels, games may also use scatter pays where any symbols appearing on a game grid as part of a game outcome may be used in evaluating symbol combinations. Here, the threshold number of reels may not need to be sequential or adjacent to each other. In embodiments of reel-based games where the total number of reels is greater, and in some examples substantially greater, than the threshold number of reels, players may lose interest in the game as it is being played, even if a payout was already triggered by the threshold number of reels, for example, while waiting for the rest of the game reels to stop before being able to start a new play. Moreover in some implementations of reel-based games, the threshold number of reels may result in a very low payout (e.g., a 1:1 payout to wager), with a greater number of reels increasing the payout, sometimes significantly (e.g., a 2:1 (2× the bet), 5:1 (5× the bet), or 10:1 (10× the bet) payout to wager resulting from matching or winning symbols along a payline (or within each reel for a multi-way pay evaluation embodiment or according to a scatter pay) on the threshold number of reels plus one, the threshold number of reels plus two, or the threshold number of reels plus three, respectively). In such examples, once a player receives a payout for the threshold number of reels and recognizes that the threshold number of reels plus one does not result in a greater payout, then the player may become impatient or lose interest while the remaining reels sequentially stop before the player may start a new game. The features of games 10 herein overcome this deficiency of historical reel-based wagering games, as opportunities for increased payouts are presented with the sequential stopping of reels 12 following the threshold number of reels having stopped.

With the above as a framework, some games 10 may be described as providing a player with an opportunity to win a subsequent payout, which subsequent payout optionally may be greater than an initial payout. For example, in games 10 in which reels 12 are sequentially stopped, when at least the threshold number of reels are stopped and result in a payout condition, followed by a subsequent reel not resulting in an increased or additional payout, the stopped reels are shifted one column over (e.g., to the right in a left to right paying game or to the left in a right to left paying game), and a spinning reel in the first reel position of the threshold number of reels (referred to herein as a "bonus reel" 30) is presented. This bonus reel 30 is subsequently stopped and provides an additional opportunity for matching or winning symbols with the previously stopped and winning reels to result in an increased or additional payout.

Stated differently, a reel-based wagering game method according to the present disclosure may comprise displaying changing reels, then sequentially stopping at least a subset of the changing reels to display stopped reels, and evaluating whether the displayed game symbols of the first X stopped reels correspond to a first payout condition, where X is an integer corresponding to a threshold number of reels to result in any payout condition. Responsive to the displayed game symbols of the first X stopped reels corresponding to the first payout condition, such a reel-based wagering game method further may comprise evaluating whether the displayed game symbols of the first X+1 stopped reels correspond to a second payout condition, and responsive to the displayed game symbols of the first X+1 stopped reels not corresponding to the second payout condition, displaying a bonus reel as a changing reel and then as a stopped reel and evaluating whether the displayed game symbols of the first X stopped reels and of the bonus reel correspond to a third payout condition.

Figure 5:
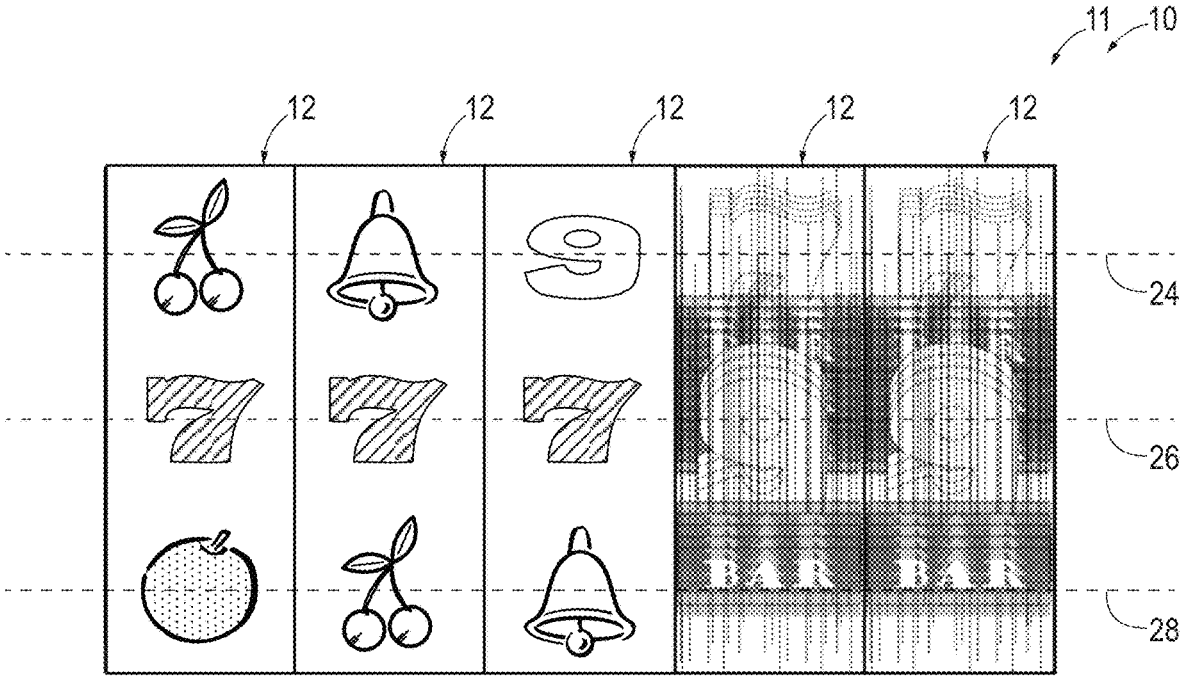
FIG. 5 is a representation of an example game of FIG. 1 in sequence with FIGS. 2-4, with all three left-most reels depicted in stopped states and leading to a payout condition.
Figure 6:
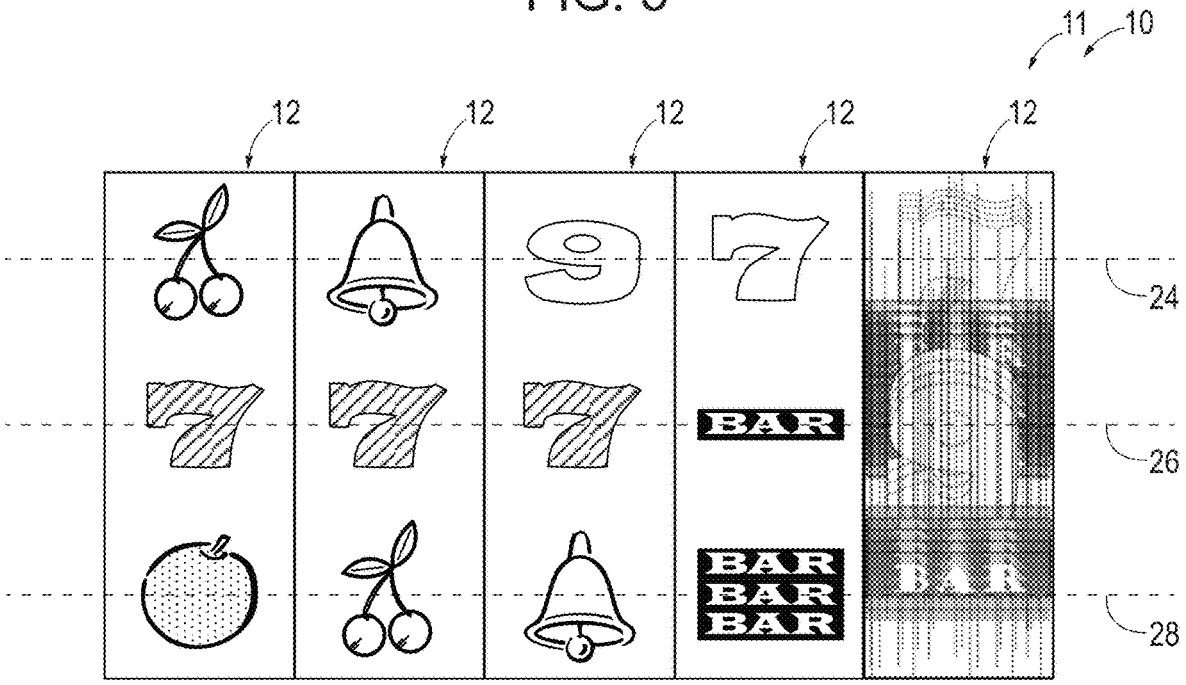
FIG. 6 is a representation of an example game of FIG. 1 in sequence with FIGS. 2-5, with the four left-most reels depicted in stopped states, with the three left-most reels corresponding to a payout condition, and with the fourth reel not corresponding to the payout condition of the three left-most reels.
Figure 7:
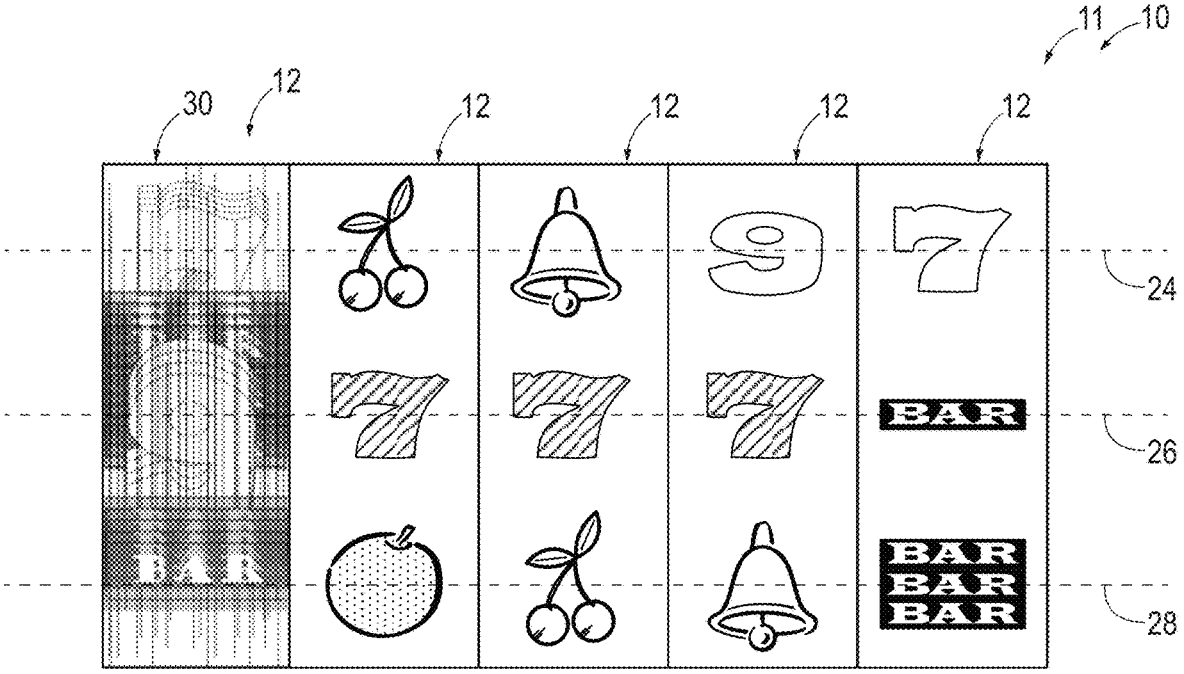
FIG. 7 is a representation of an example game of FIG. 1 in sequence with FIGS. 2-6, with the four initially left-most reels shifted one column to the right and depicted in stopped states, and with a bonus reel in the first column depicted in a changing state.
Figure 8:
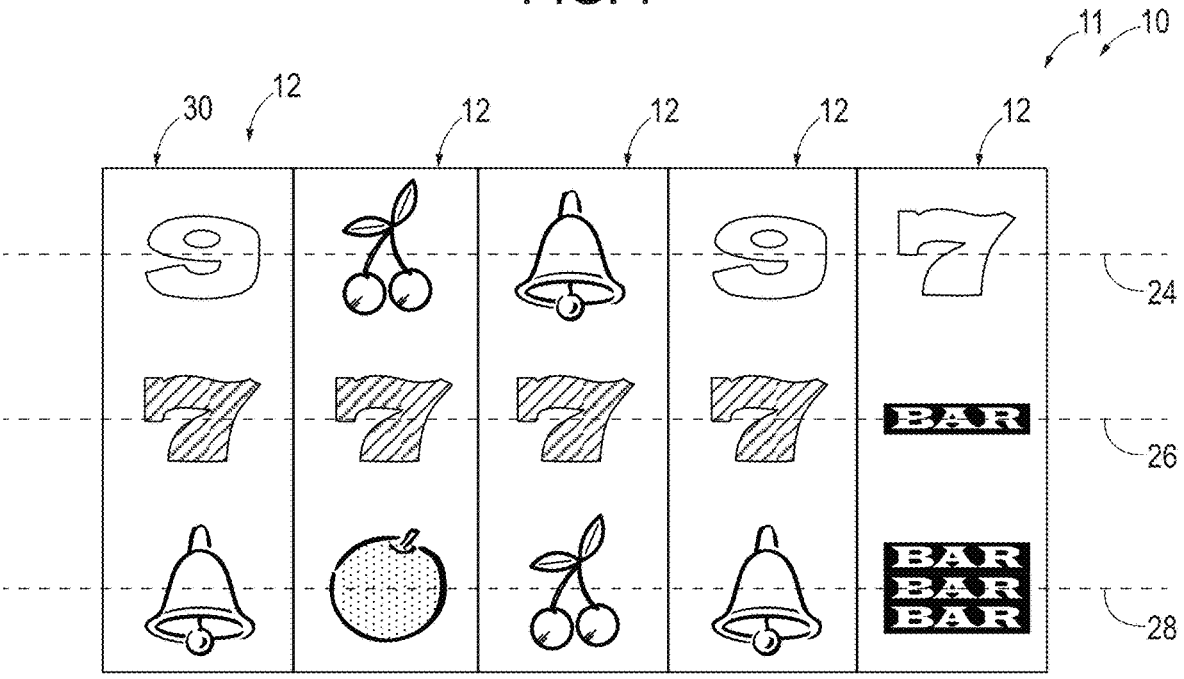
FIG. 8 is a representation of an example game of FIG. 1 in sequence with FIGS. 2-7, with all five reels depicted in stopped states, and with the bonus reel corresponding to an additional or increased payout condition with the original three left-most reels.

For example, with game 11 having an example threshold number of reels equal to three and with reference to the sequence of FIGS. 2-8, as the reels 12 are sequentially stopped, the symbol combinations associated with paylines 22 are evaluated according to a payout scheme. In the illustrated example through FIG. 6, the three left-most stopped reels each include a matching symbol along payline 26, namely, a shaded 7; however, the fourth reel has no matching symbols that otherwise result in a payout condition with the first three reels. In the example of game 11 with the threshold number of reels equal to three, the first three reels 12 with the three matching symbols along payline 26 result in a payout condition; however, the player is given an additional opportunity to have at least four reels result in a payout condition. More specifically, in the sequence of FIGS. 6 and 7, the four left-most stopped reels are all shifted one column to the right, and a bonus reel 30 is presented and spun in the left-most column of grid 16, as shown in FIG. 7. FIG. 8 shows an optional result in which an additional matching symbol (i.e., a shaded 7) along payline 26 results in an additional or increased payout corresponding to four matching symbols, which otherwise would not have resulted without implementation of the present disclosure.

In some examples of games 10, including game 11, the bonus reel 30 may be a completely new reel with an independent reel strip. In some such examples, the new reel may include one or more stacks of symbols (i.e., having a reel strip that includes one or more continuous sequences of identical symbols), where the stacks include the winning symbol that matches the winning symbols of the stopped reels already established during game play prior to the bonus reel being triggered. In some embodiments, multiple possible bonus reel strips may be used so that there is at least one bonus reel with at least one stack of symbols corresponding to each of the possible symbols on the other reel strips used in evaluating symbol combinations. Alternatively, a single bonus reel strip may be used where the symbol used in a stack of symbols is inserted or replaces other default symbols depending on what winning symbol is needed to match the winning symbols of the stopped reels. In such examples, when the bonus reel is displayed in a spinning state, a player will be able to see the winning symbol present on the bonus reel (due to the continuous sequence of identical symbols), creating anticipation of an increased or additional payout.

In other examples, the bonus reel 30 may use the same reel strip as the reel whose position it now occupies. In the example of game 11 and the sequence depicted in FIGS. 2-8, the bonus reel therefore may have the same reel strip as the original first reel (of FIGS. 2-6).

In other examples, the bonus reel may be a duplicate of the reel that in sequence triggered the bonus reel (i.e., the subsequent reel not resulting in an increased or additional payout). In the example of game 11 and the sequence depicted in FIGS. 2-8, the bonus reel therefore may have the same reel strip as the original fourth reel (of FIGS. 2-6).

In yet other examples, the bonus reel may be a duplicate of the last reel (e.g., the right-most reel in a left to right paying game), such that the final reel is effectively shifted off one side of the grid and back onto the other side of the grid as the bonus reel. In the example of game 11 and the sequence depicted in FIGS. 2-8, the bonus reel therefore may have the same reel strip as the original fifth reel (of FIGS. 2-6). Other examples also are within the scope of games 10 according to the present disclosure.

In some examples of game 10, when the threshold number of reels results in a payout condition, a payout may be paid, or otherwise accumulated, at the time the last reel of the threshold number of reels stops and shows a matching symbol or at the time the subsequent reel stops and does not have a matching symbol. For example, in the sequence of FIGS. 2-8, a payout corresponding to three matching reels may be paid immediately after the third reel stops, as shown in FIG. 5, or after the fourth reel stops, as shown in FIG. 6. Then, if the bonus reel, as discussed above, subsequently results in an additional payout condition, such as shown in FIG. 8, then a second payout corresponding to four matching symbols may be paid. In such implementations, the player receives two payouts—one associated with the original threshold number of reels and one associated with the threshold number of reels plus one.

In other examples of game 10, rather than paying a payout corresponding to the threshold number of reels and additionally paying a payout corresponding to the threshold number of reels plus one, when a bonus reel results in a matching symbol, game 10 may wait to payout until after the bonus reel has stopped, and upon the bonus reel resulting in a payout condition, the game may only make a single payout corresponding to the threshold number of reels plus one (e.g., corresponding to four reels with matching symbols in the example game 11 of FIGS. 2-8).

Figure 9:
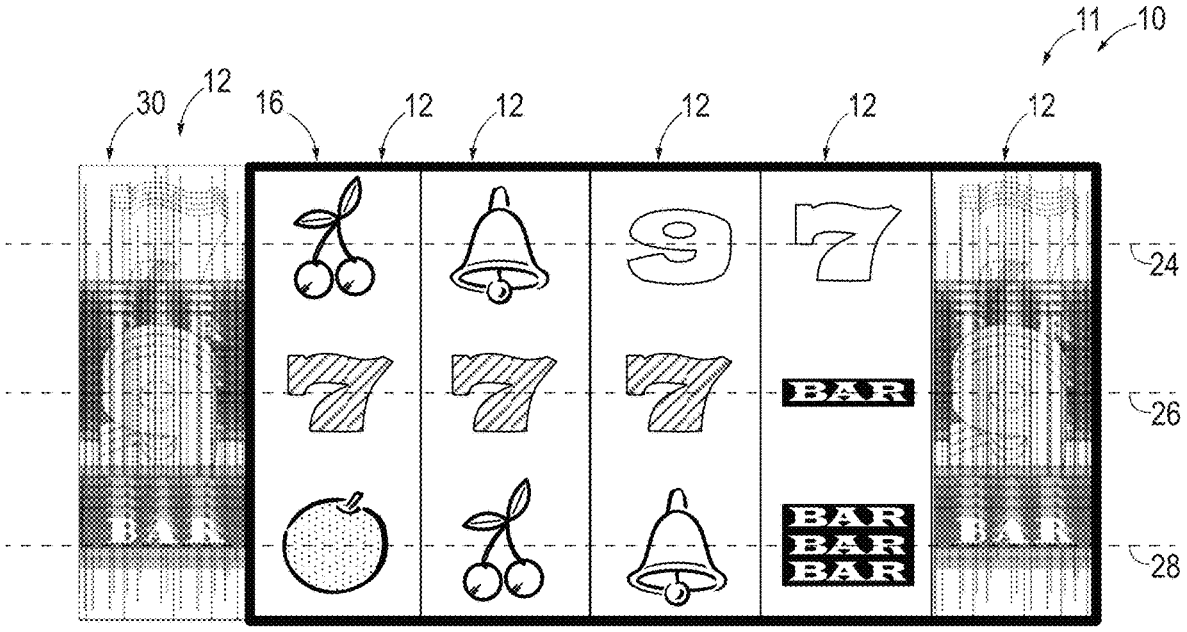
FIG. 9 is a representation of an example game of FIG. 1 in sequence with FIGS. 2-6, with a bonus reel depicted in a changing state to the left of the default grid.
Figure 10:
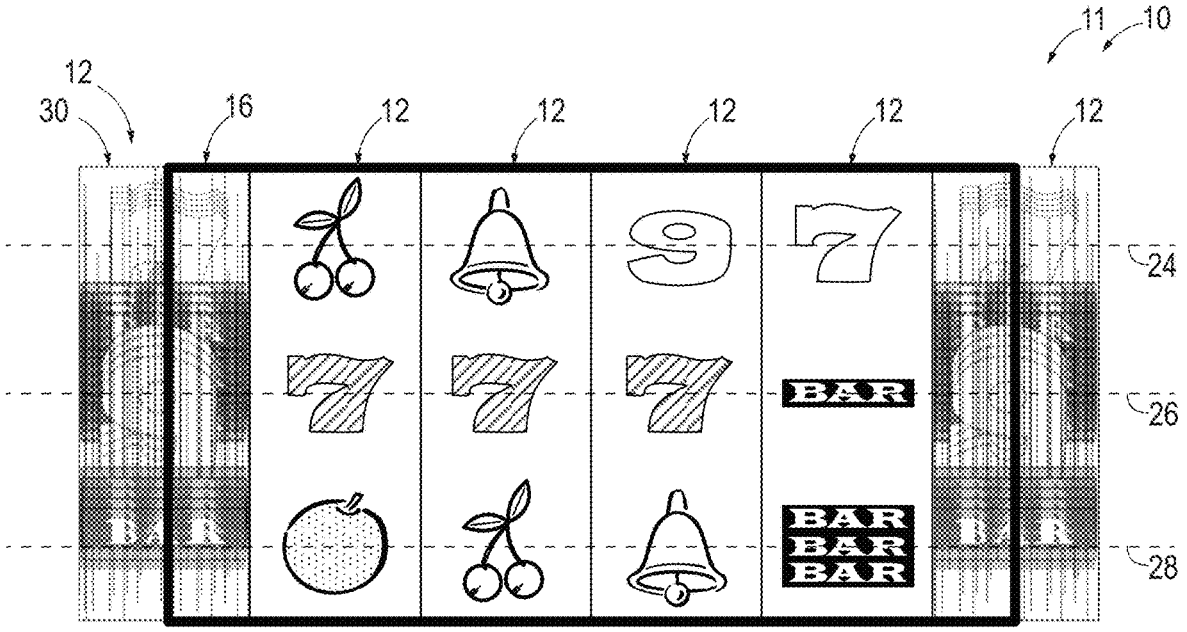
FIG. 10 is a representation of an example game of FIG. 1 in sequence with FIGS. 2-6 and 9, with all six reels, including the original five reels and the bonus reel, depicted as shifting to the right from the positions illustrated in FIG. 9.

In the example game 11 depicted in FIGS. 2-8, a grid 16 of five reels 12 with three rows 18 of symbols 14 is generally maintained during the duration of game play. However, it is within the scope of games 10 that the grid may be dynamic and changing during game play to account for the bonus reel that is triggered during game play. For example, FIGS. 9 and 10 illustrate an example in sequence with FIGS. 2-6 (i.e., in place of FIG. 7), in which the bonus reel is first presented as a spinning reel outside of the default grid area (FIG. 9), and then the reels visually shift to the right, with the bonus reel 30 shifting into the grid and the right-most reel shifting out of the grid (FIG. 10). In some such examples, the portions of the reels outside of the default grid area may be shown but visually altered, such as greyed, lightened, textured, reduced in size, visually wrapped into the screen as if on a curved surface, etc.

Figure 11:
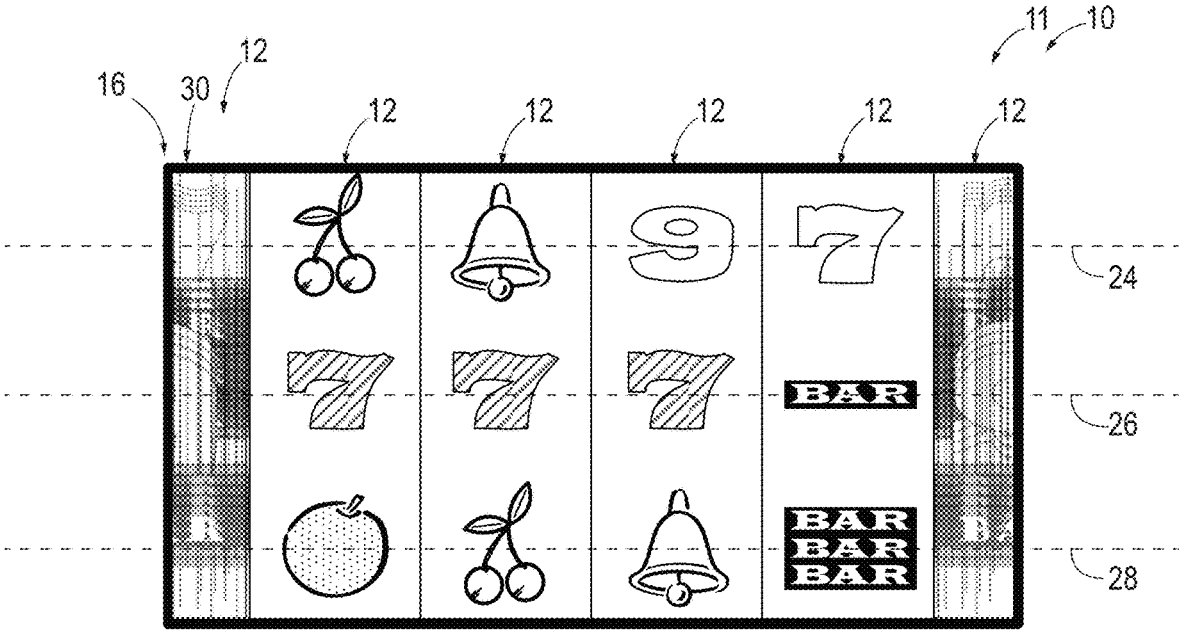
FIG. 11 is a representation of an example game of FIG. 1 in sequence with FIGS. 2-6, with a bonus reel depicted in a changing state to the left of the original left-most reel, and with all six reels, including the original five reels and the bonus reel, depicted as shifting to the right from the positions illustrated in FIG. 6.
Figure 12:
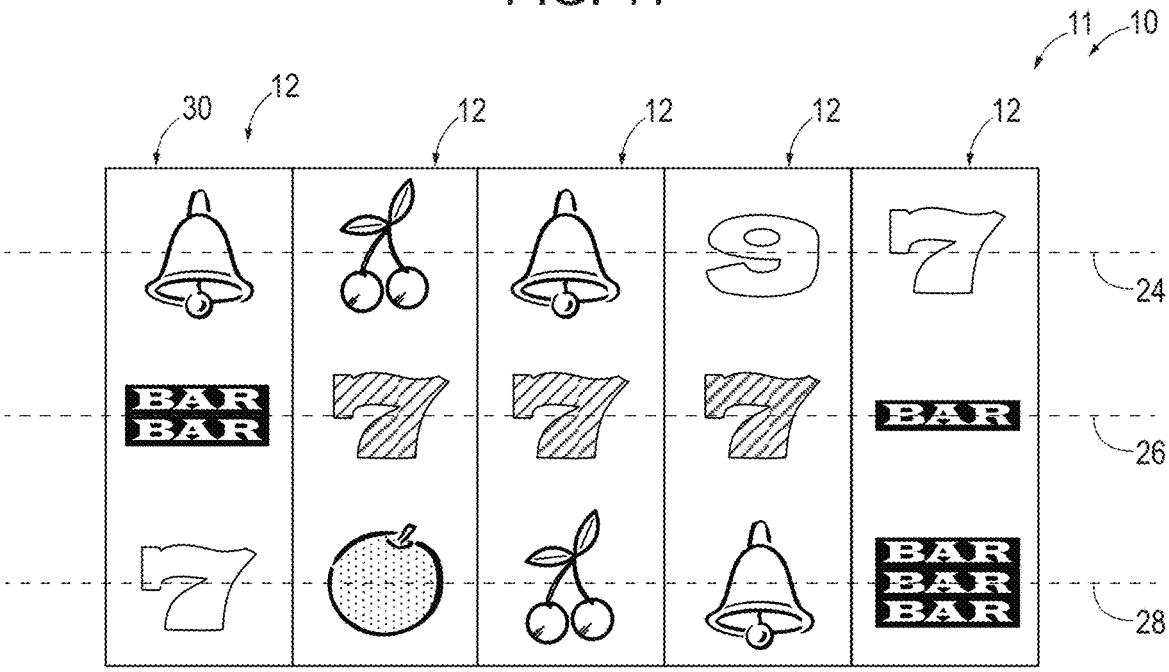
FIG. 12 is a representation of an example game of FIG. 1 in sequence with FIGS. 2-7, with all five reels depicted in stopped states, and with the bonus reel not corresponding to an additional or increased payout condition with the original three left-most reels.

In yet other examples, such as shown in the example of FIG. 11, rather than presenting any portion of reels, including the bonus reel 30, outside of the default grid area, the portions of the reels that would be outside of the default grid area may not be shown, such that the right-most reel is effectively disappearing as it is shifted to the right out of the grid area and such that the bonus reel 30 is effectively appearing as it is shifted to the right into the grid area. Other examples also are within the scope of games 10, including examples in which only one of the right-most reel (or left-most reel in the example of a right to left paying game) or the bonus reel is depicted in full during the shifting of the reels, while the other of the two reels is not depicted in full during the shifting of the reels.

In some games 10, a spinning bonus reel 30 may be depicted to the left of the default grid area (or to the right in a right to left paying game) even before the initiation of a bonus reel being triggered, including at the very beginning of gameplay. For example, with reference to the example of game 11 in FIGS. 2-8, a spinning bonus reel 30 may be depicted to the left of the grid in all of FIGS. 2-6. Alternatively, a stopped bonus reel 30 may be depicted to the left (or to the right) of the default grid area, optionally with winning or high value (e.g., major) symbols being shown before initiation of the bonus reel being triggered, which may then be spun when it is utilized. Accordingly, the presence of the spinning (or stopped) bonus reel 30 gives the player anticipation of triggering the bonus reel, and upon being triggered, the game may proceed as optionally discussed above in connection with FIGS. 9-10. Moreover, when a stopped bonus reel is depicted with a winning symbol, the player is alerted to the fact that an increased or additional payout is possible with the actual bonus reel present, thereby providing anticipation and otherwise maintaining the player's interest in the game.

In yet other examples, rather than shifting the reels to the right (or to the left), the bonus reel simply may maintain its position to the left of the default grid area (or to the right in the example of a right to left paying game).

Additionally or alternatively, some games 10 may display more than one spinning (or stopped) bonus reel 30 outside of the default grid area, effectively communicating to the player that such bonus reels may be triggered upon an appropriate event as discussed herein. To some extent, the implementation of games 10 and the depiction of reels 12 thereof, including the optional dynamic nature of the grid and including the optional depiction of one or more bonus reels 30 outside of the default grid area, may be affected by the size of display screen of an implementing gaming apparatus, the size of grid 16 in a particular game 10, etc.

Figure 13:
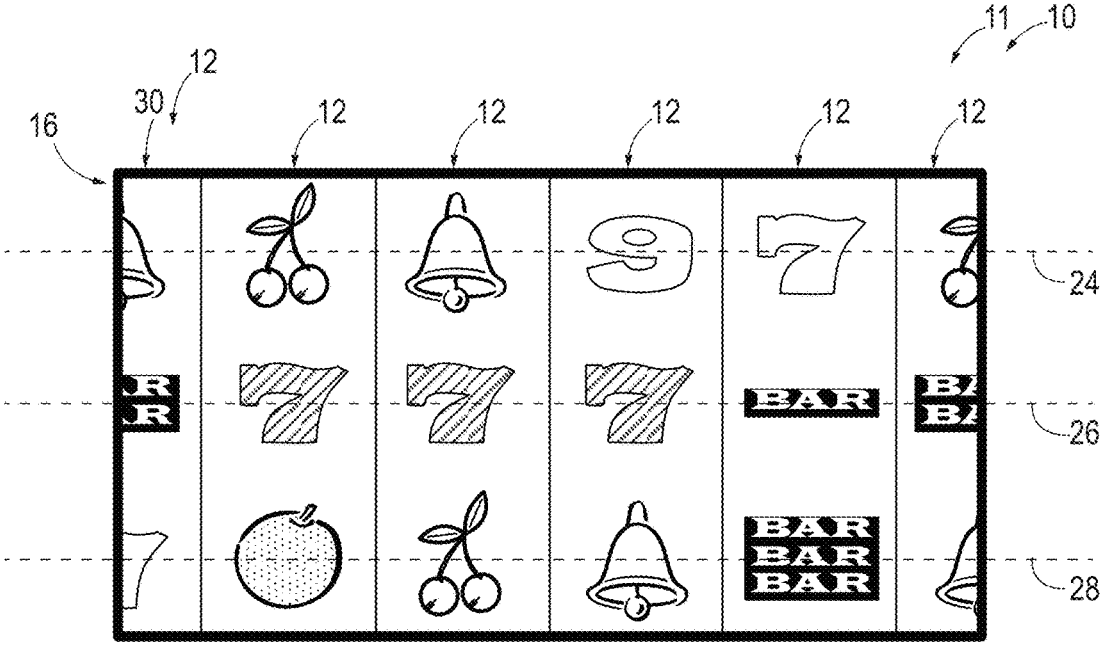
FIG. 13 is a representation of an example game of FIG. 1 in sequence with FIGS. 2-7 and 12, with the reels depicted as shifting back to the left so that the original five reels return to their original location within the default grid.
Figure 14:
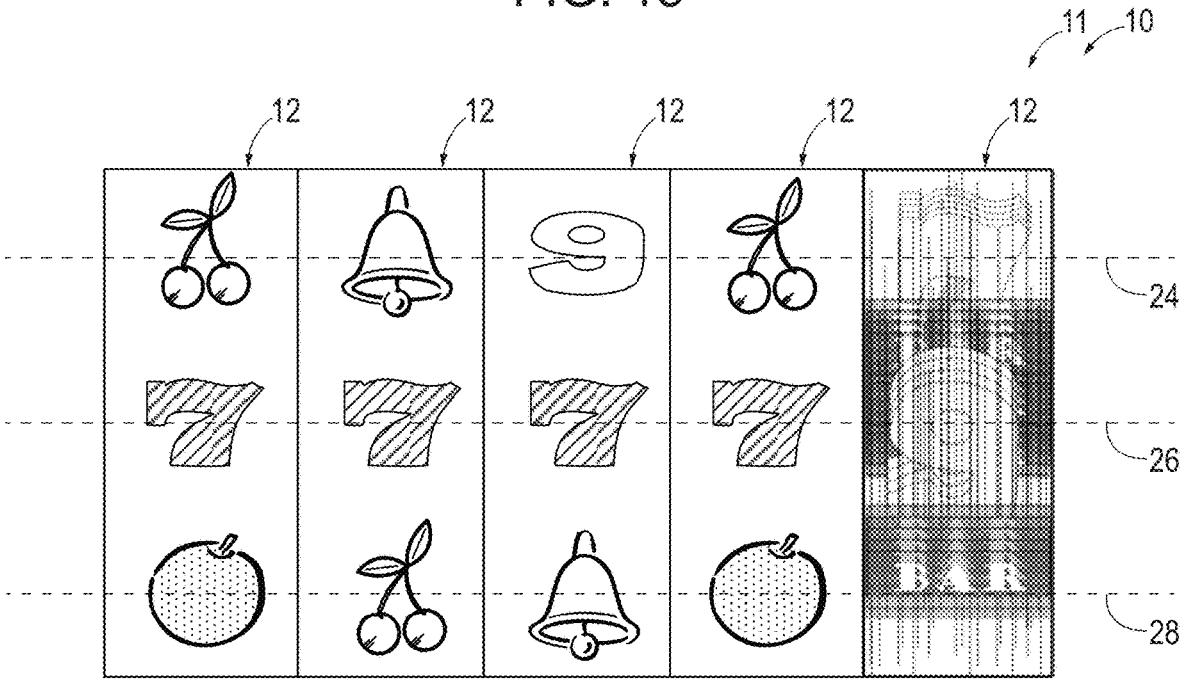
FIG. 14 is a representation of an example game of FIG. 1 in sequence with FIGS. 2-5, with the four left-most reels depicted in stopped states, and with the four left-most reels corresponding to a payout condition.
Figure 15:
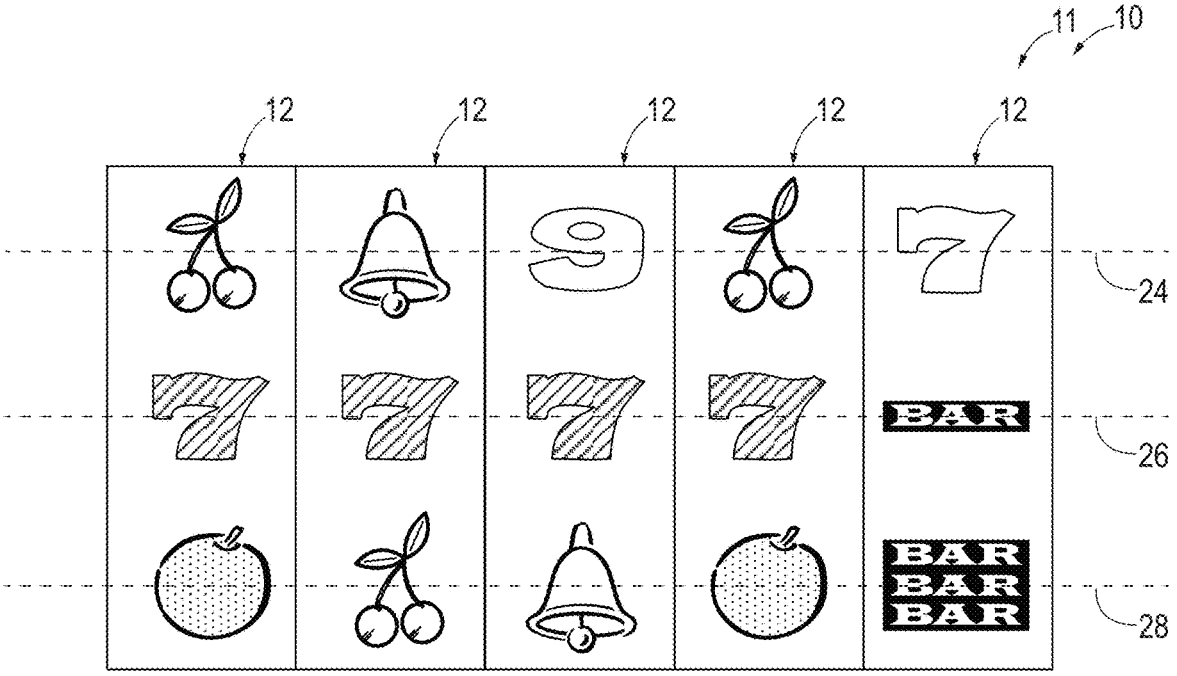
FIG. 15 is a representation of an example game of FIG. 1 in sequence with FIGS. 2-5 and 14, with all five reels depicted in stopped states, and with the fifth reel not corresponding to a payout condition with the four left-most reels.
Figure 16:
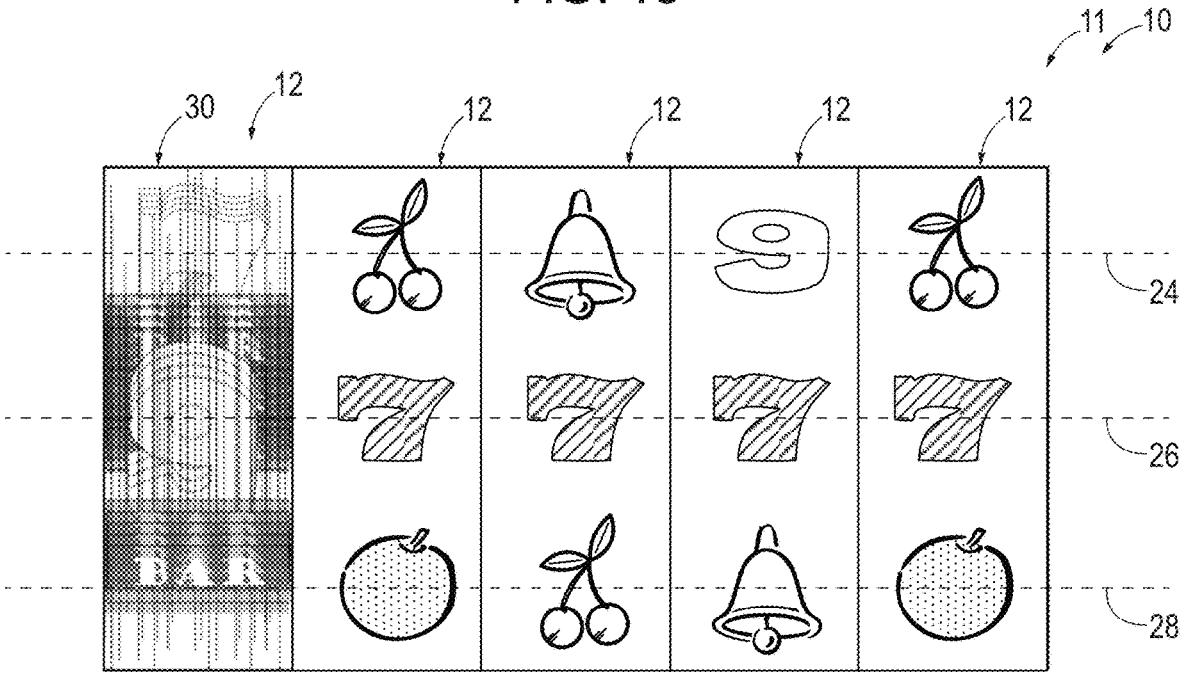
FIG. 16 is a representation of an example game of FIG. 1 in sequence with FIGS. 2-5, 14, and 15, with the four initially left-most reels shifted one column to the right and depicted in stopped states, and with a bonus reel in the first column depicted in a changing state.

In some implementations of game 10, when the bonus reel 30 does not result in an increased or additional payout, the reels may be shifted back to their respective original locations within grid 16. For example, with reference to FIGS. 12 and 13, which are in sequence with FIGS. 2-6, the bonus reel 30 in FIG. 12 does not have any symbols that result in a payout together with the second, third, and fourth depicted reels, which started as the first three reels. In FIG. 13, the reels are depicted as shifting back to the left.

Figure 17:
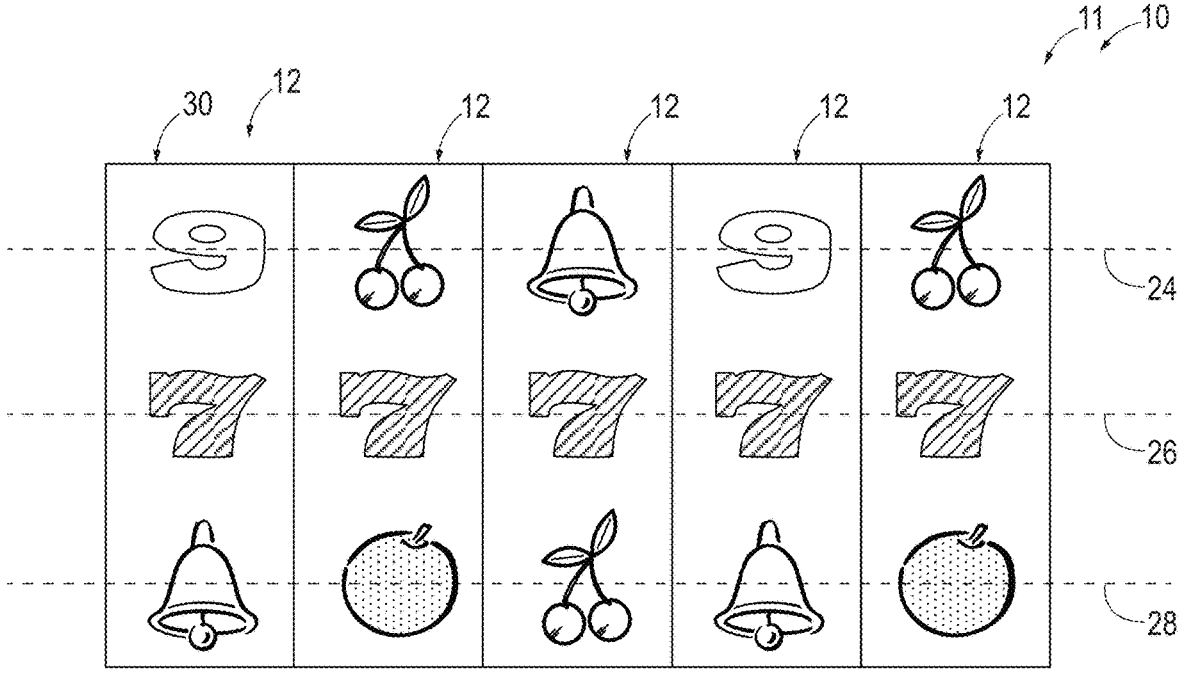
FIG. 17 is a representation of an example game of FIG. 1 in sequence with FIGS. 2-5 and 14-16, with all five reels depicted in stopped states, and with the bonus reel corresponding to an additional or increased payout condition with the original four left-most reels.

The above various examples of game 11 depicted in FIGS. 2-13 illustrate implementations of games 10 in which the bonus reel 30 is triggered upon the subsequent reel (following the threshold number of reels resulting in an initial payout condition) not resulting in an additional or increased payout condition. However, the bonus reel may be triggered at any suitable moment during play of a game 10, including responsive to a subsequent reel (following more than the threshold number of reels resulting in an initial payout condition) not resulting in an additional or increased payout condition. For example, in sequence with FIGS. 2-5, FIGS. 14-17 illustrate an example implementation of game 11 in which the first four reels result in a payout condition with a matching symbol along payline 26, but with the fifth reel (in FIG. 15) having no matching symbols that otherwise result in a payout condition with the first four reels. In this depicted example, the first four reels are shifted to the right and a bonus reel 30 is shifted into the first column of the grid, ultimately resulting in an increased or additional payout condition with all five reels having a matching symbol along payline 26, as shown in FIG. 17.

Also within the scope of games 10, are examples in which the bonus reel 30 is triggered even when the threshold number of reels does not result in a payout condition, for example, with the bonus reel being triggered when the threshold number of reels minus one does not result in a payout condition.

Stated differently, a reel-based wagering game method according to the present disclosure may comprise displaying changing reels, then sequentially stopping at least a subset of the changing reels to display stopped reels, and evaluating whether the displayed game symbols of the first X−1 stopped reels lead to a first payout condition, where X is an integer corresponding to a threshold number of reels to result in any payout condition. Responsive to the displayed game symbols of the first X−1 stopped reels leading to the first payout condition, such a reel-based wagering game method further may comprise evaluating whether the displayed game symbols of the first X stopped reels correspond to the first payout condition, and responsive to the displayed game symbols of the first X stopped reels not corresponding to the first payout condition, displaying a bonus reel as a changing reel and then as a stopped reel and evaluating whether the displayed game symbols of the first X−1 stopped reels and of the bonus reel correspond to a second payout condition.

Figure 18:
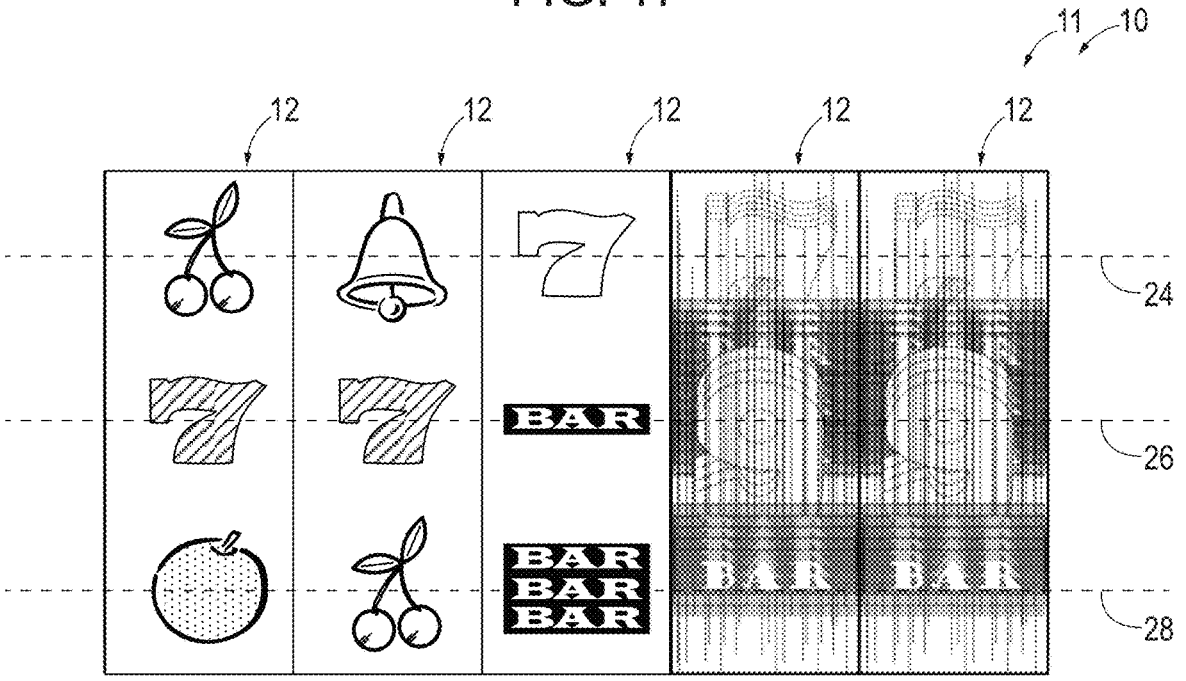
FIG. 18 is a representation of an example game of FIG. 1 in sequence with FIGS. 2-4, with the three left-most reels depicted in stopped states and not corresponding to a payout condition.
Figure 19:
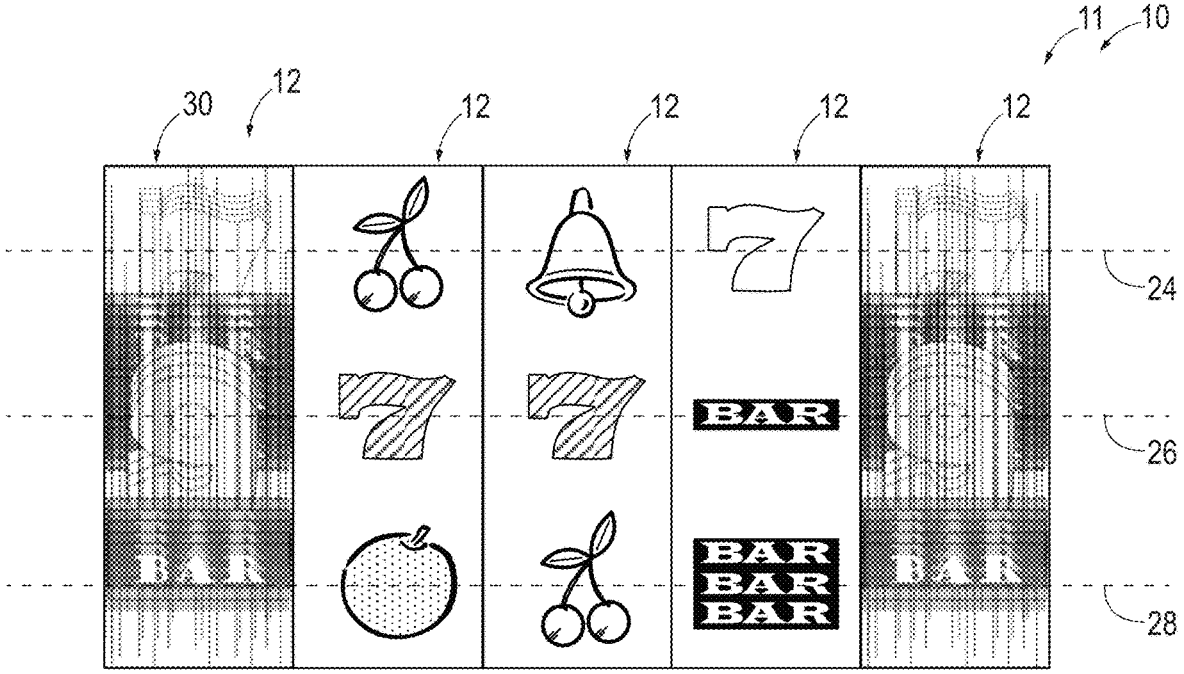
FIG. 19 is a representation of an example game of FIG. 1 in sequence with FIGS. 2-4 and 18, with the four initially left-most reels shifted one column to the right and maintaining their respective state of FIG. 18, and with a bonus reel in the first column depicted in a changing state.
Figure 20:
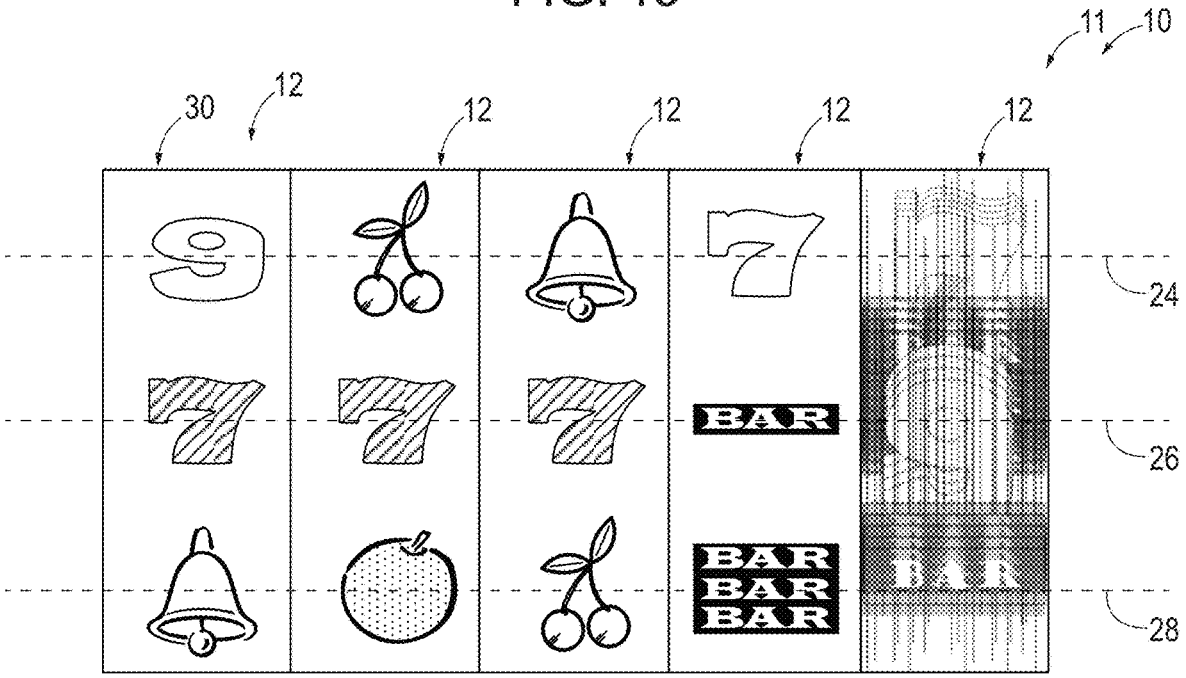
FIG. 20 is a representation of an example game of FIG. 1 in sequence with FIGS. 2-4, 18, and 19, with the bonus reel and the two initially left-most reels corresponding to a payout condition.

As an example, in sequence with FIGS. 2-4, FIGS. 18-20 illustrate an example implementation of game 11 in which the first two reels each include a matching symbol along payline 26, but the third reel does not have a matching symbol. Accordingly, if the threshold number of reels is three, then no payout is triggered under a default payout; however, as shown in the sequence of FIGS. 18-20, following the third reel having stopped, the stopped reels are shifted to the right, and a bonus reel 30 is shifted into the first column, giving the player another opportunity (or second chance) to result in a payout, with the depicted example doing so in FIG. 20, with three shaded 7s along payline 26. In the example illustrated, the original fourth reel remains spinning as it is shifted to the fifth column and while the game continues to be played; however, it is within the scope of games 10 that such a reel not resulting in a payout opportunity may be stopped or otherwise removed from play, including optionally being removed from display altogether.

While the above examples have generally been described in connection with left to right and right to left paying games, in which a first reel participates in any payout condition, other implementations of game 10 are within the scope of the present disclosure, including games in which paylines or scatter pay do not require a terminal (i.e., left-most or right-most) reel to include a winning symbol. As an illustrative, non-exclusive example only, with reference to FIG. 1, a game 10 may incorporate paylines or scatter pays that overlap, or otherwise are associated with, the three middle reels. Additionally or alternatively, a game 10 may be implemented in connection with paylines or scatter pays that overlap, or otherwise are associated with, non-sequential reels, such as the first, third, and fifth reels in the example of FIG. 1, as discussed above. Other examples also are within the scope of games 10 according to the present disclosure.

As discussed, in some implementations of game 10, a bonus reel 30 may be triggered only if a first payout condition is met, such as being associated with symbols on at least the threshold number of reels. In some such examples, the bonus reel may be triggered only when the matching symbols fall within a predetermined subset of the symbols associated with the game, such as being, for example, major symbols, which typically result in higher payouts than minor symbols. In such implementations, the triggering of the bonus reel may be more exciting to players than if it were triggered based on minor symbols, which may not result in a significantly greater payout even if the bonus reel were to result in an increased or additional payout. On the other hand, in other implementations, the bonus reel 30 may be triggered only when the matching symbols are minor symbols, thereby giving a player an opportunity to achieve an increased payout based on the bonus reel, despite the minor symbols typically only resulting in a minimal payout. In yet other implementations, this feature may only be used with bonus, scatter, progressive, jackpot, and/or top award symbols.

In some examples of games 10, when the bonus reel 30 is triggered, the game automatically proceeds as set forth above to be displayed, stopped, and evaluated for a payout, an increased payout, or an additional payout. That is, the bonus reel may be automatically implemented. In other examples of games 10, when a condition that triggers the bonus reel occurs, the player may be given an opportunity to place an additional wager (or not) before the bonus reel is permitted to proceed, become stopped, and be evaluated. In some such examples, the bonus reel may be displayed as a spinning reel, or some other visual or audible notification may occur, to entice the player, or at least notify the player and seek player input, to place an additional wager before proceeding. In such examples, the additional wager may be described as "side bet" or "side wager" on the bonus reel. The side wager amount may be predefined or may be dynamically calculated based on an expected outcome with the given stopped reels and the potential payouts based on the bonus reel.

Figure 21:
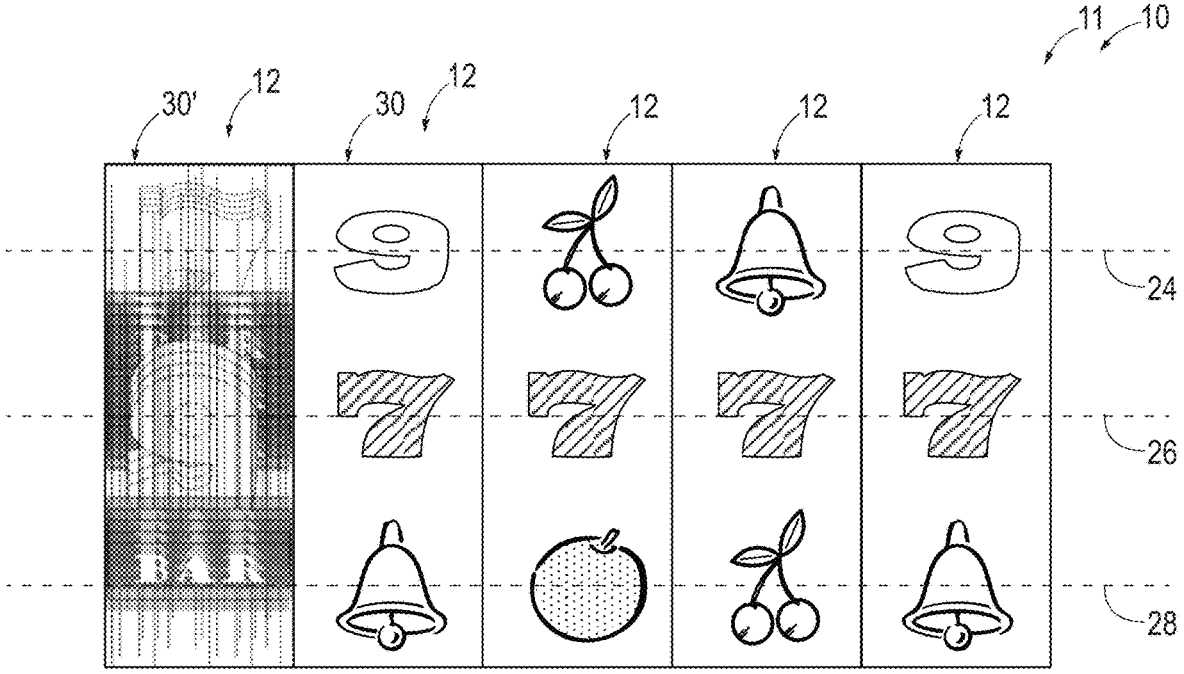
FIG. 21 is a representation of an example game of FIG. 1 in sequence with FIGS. 2-8, with the four right-most reels depicted in stopped states and a second bonus reel depicted in a changing state in the first reel position.
Figure 22:
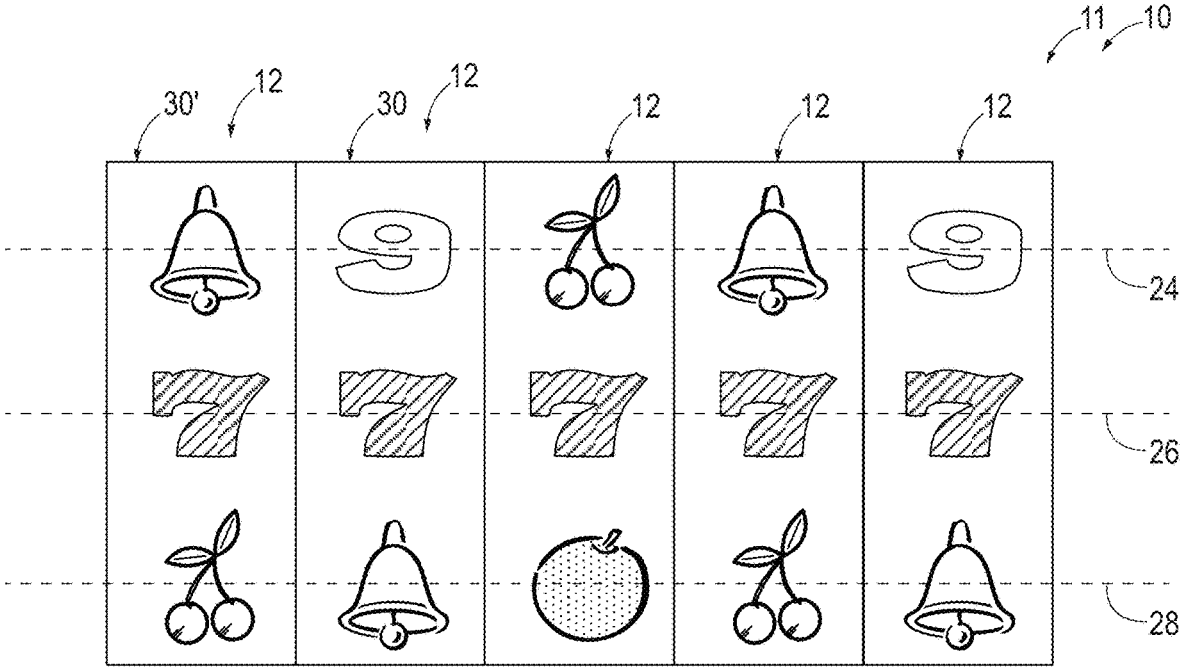
FIG. 22 is a representation of an example game of FIG. 1 in sequence with FIGS. 2-8 and 21, with all five reels, including two bonus reels, depicted in stopped states.

In some games 10, more than one bonus reel 30 may be available to be triggered. For example, upon a first bonus reel 30 being triggered and resulting in an additional or increased payout, a second bonus reel 30 may be triggered, giving a player multiple opportunities for additional or increased payouts. For example, in sequence with FIGS. 2-8, upon a first bonus reel 30 resulting in an increased or additional payout (FIG. 8), FIGS. 21-22 show the reels shifting again to the right and a second bonus reel 30' shifting into the first reel position and ultimately stopping with a matching symbol along payline 26 (FIG. 22). In some examples, the reels 12 may continue to shift with additional bonus reels being triggered and entering the grid to be evaluated for a payout, so long as additional matching symbols result in an increased or additional payout. That is, additional bonus reels 30 may be triggered until such time that a bonus reel does not result in an increased or additional payout. Additionally or alternatively, after a bonus reel 30 does not result in an increased or additional payout, the reels 12 may shift back to a position in which the left-most reel (or right-most reel in a right to left paying game) begins the paying symbol combination, at which point an evaluation of the symbols and payout may occur.

Figure 23:
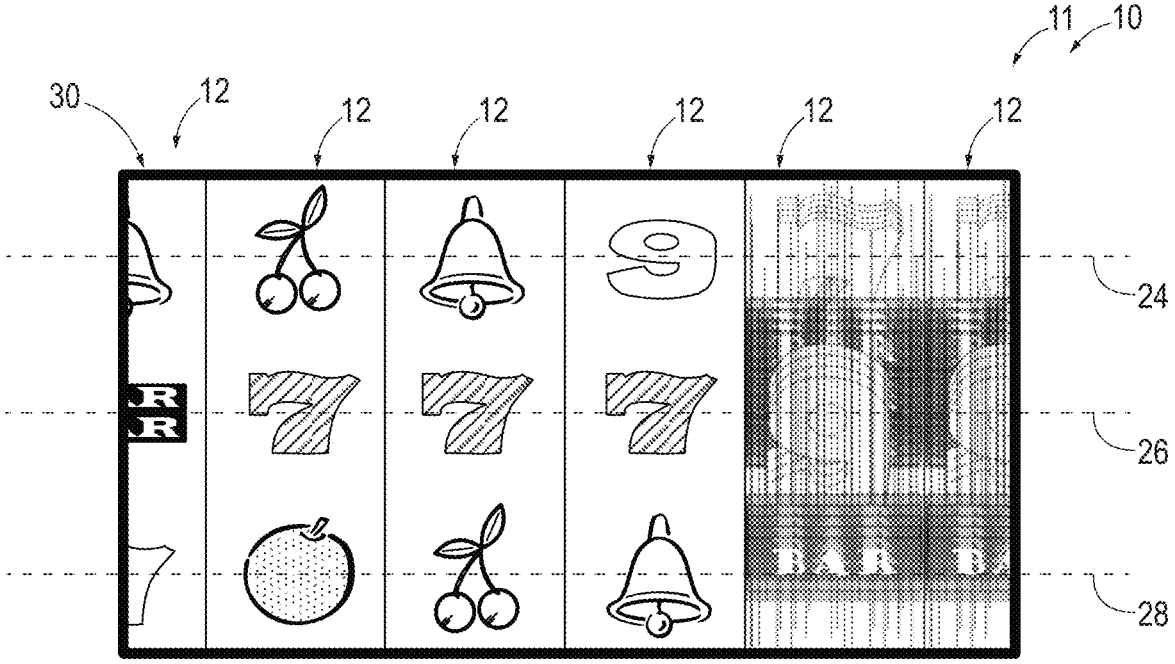
FIG. 23 is a representation of an example game of FIG. 1 in sequence with FIGS. 2-6 and 12, with the reels depicted as shifting back to the left so that the original five reels return to their original location within the default grid, and with the two right-most reels depicted in a changing state.

In some examples of games 10, when the reels 12 are shifting back into the default grid following a bonus reel 30 not resulting in an increased or additional payout, the original reels 12 that originally did not contribute to a payout (e.g., did not have any matching symbols according to a payout scheme) may respin (or continue spinning, in the instance of a subsequent reel not having been reached before a bonus reel 30 was triggered), giving a player yet additional opportunities for a payout. For example, with reference to FIG. 23, which is in sequence with FIGS. 2-6 and 12, after the bonus reel 30 does not result in an additional or increased payout, the two right-most reels 12 may be respun and evaluated for a payout in connection with the original three left-most reels having matching symbols along payline 26. That is, FIG. 23 is similar to FIG. 13, but with the two right-most reels being respun as the reels shift back to the left.

Figure 24:
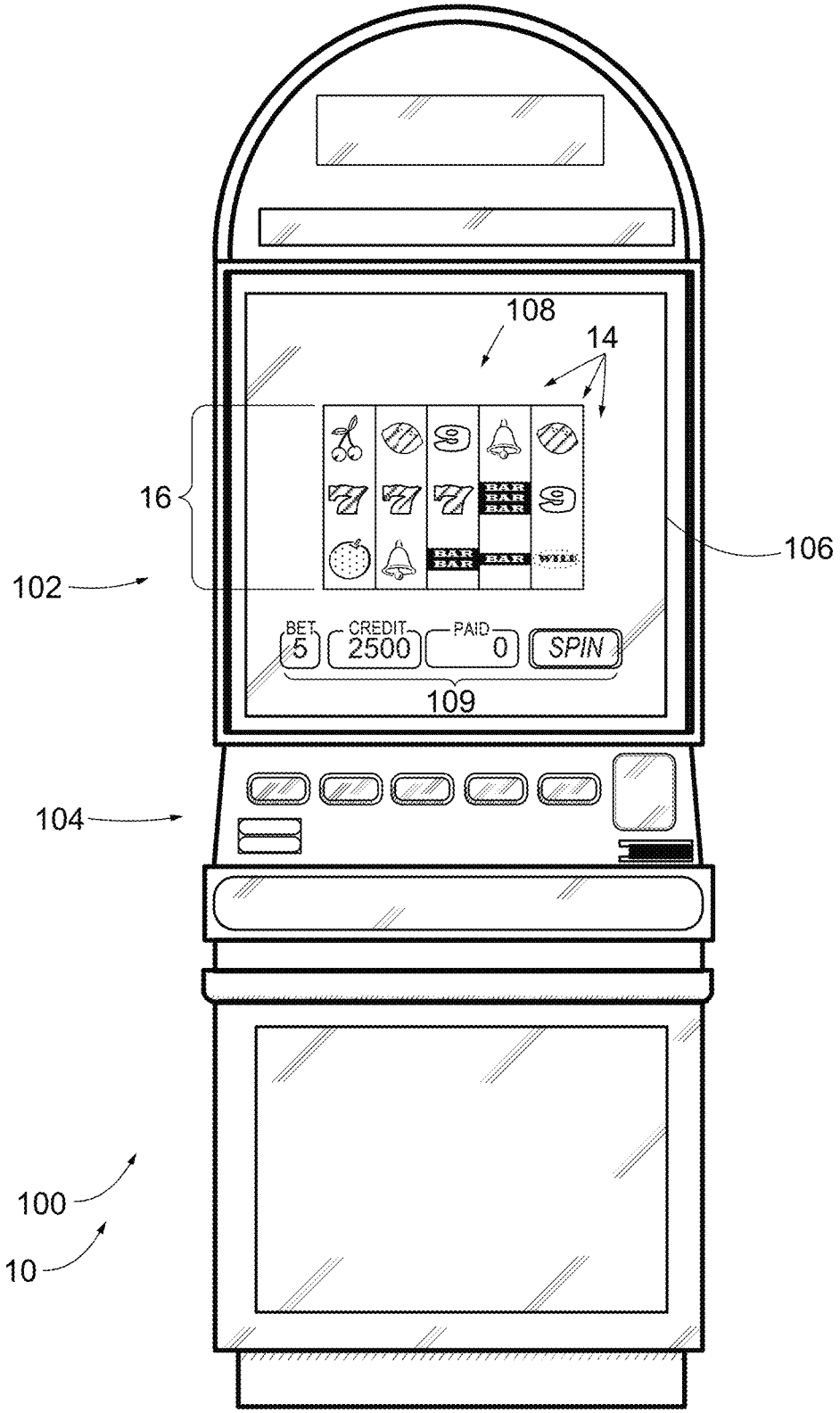
FIG. 24 is a front view of an example gaming apparatus.

Turning now to FIG. 24, an example gaming apparatus 100 that may embody a game 10 and implement a method according to the present disclosure is depicted. The gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 14 such as associated with games 10, and an operations portion 109 that can include meters, various game buttons, or other game information for a player of the gaming apparatus 100.

The user interface 104 allows the user to control and engage in play of the gaming apparatus 100 and thus of games 10. The particular user interface mechanisms included with user interface 104 may be dependent on the type of gaming device. For example, the user interface 104 may include one or more buttons, switches, joysticks, levers, pull-down handles, trackballs, voice-activated input, touch screens (including, e.g., the game display 102), or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are described below with reference to FIG. 25. For example, currency input mechanisms, card readers, credit card readers, smart card readers, punch card readers, radio frequency identifier (RFID) readers, and other mechanisms may be used to enter wagers. The user interface 104 also may include a mechanism to read and/or validate player loyalty information to identify a user or player of the gaming device. This mechanism may be a card reader, biometric scanner, keypad, or other input device. It is through the user interface 104 that the player can initiate and engage in gaming activities. While the illustrated embodiment depicts various buttons for the user interface 104, it should be recognized that a wide variety of user interface options are available for use in connection with games 10 and gaming apparatus 100, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In connection with games 10, the primary gaming portion 108 may display grid 16 (or an equivalent arrangement) of game symbols 14.

The primary gaming portion 108 may include other features known in the art that facilitate gaming, such as operations portion 109. As is generally known in the art, the operations portion 109 provides information about current bets, current wins, remaining credits, etc. associated with gaming activities of the grid 16 of game symbols 14. The operations portion 109 also may provide touchscreen controls for facilitating game play. The grid 16 also may include touchscreen features, such as facilitating selection of individual symbols, or user controls over stopping or spinning/changing reels. The game display 106 of the display area 102 may include other features that are not shown, such as paytables, navigation controls, etc.

Figure 25:
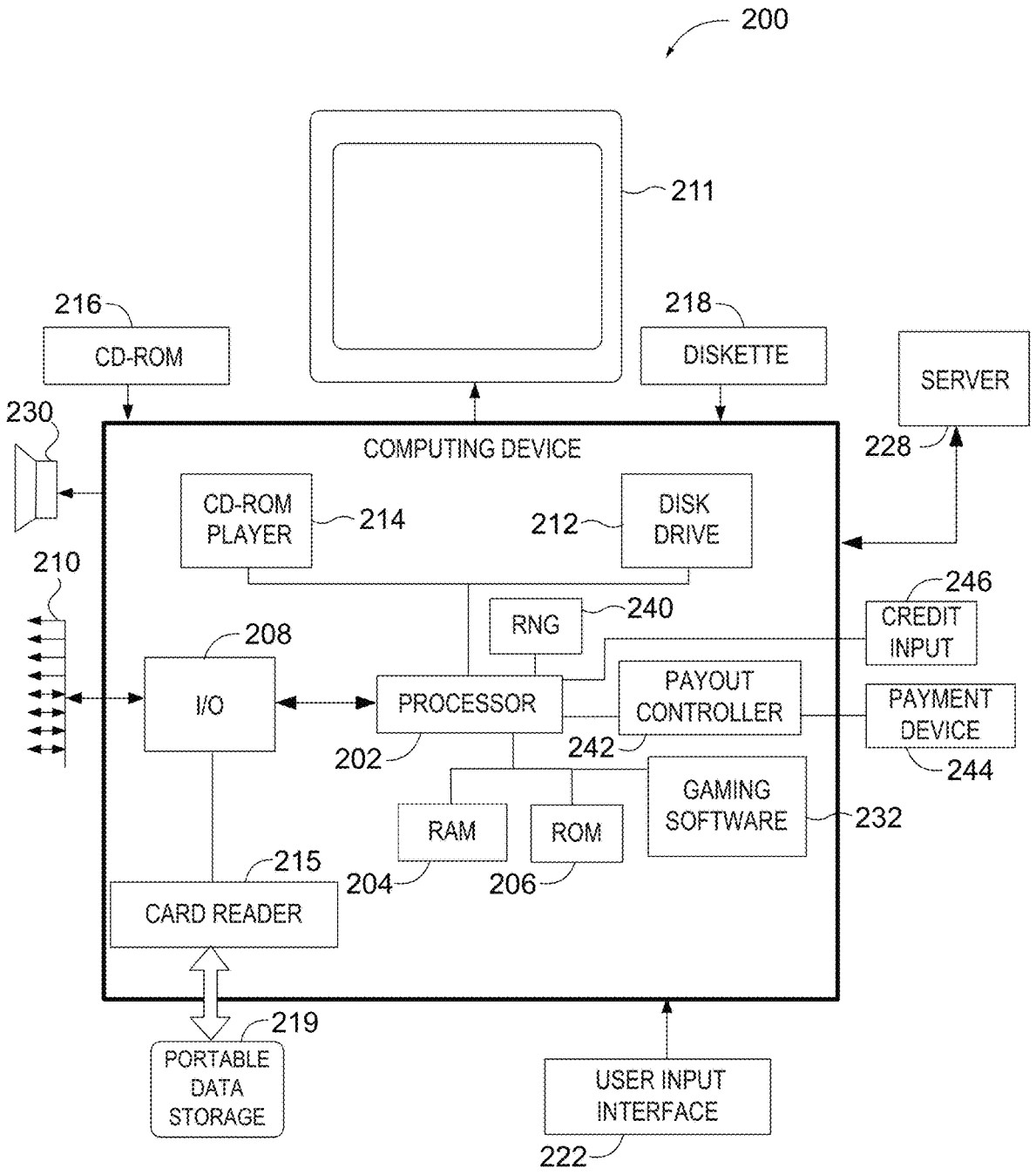
FIG. 25 is a block diagram representing an example computer arrangement.

Although FIG. 24 illustrates a particular implementation of a gaming apparatus 100 that embodies a game 10 in the form of a casino or electronic gaming machine ("EGM"), one or more devices may be programmed to play various embodiments of games 10. That is, games 10 may be implemented, as shown in FIG. 24, as a casino gaming machine or other special purpose gaming kiosk as described herein, or may be implemented via computing systems operating under the direction of local gaming software, and/or remotely-provided software such as provided by an application service provider (ASP). Casino gaming machines also may utilize computing systems to control and manage the gaming activity, although these computing systems typically include specialized components and/or functionality to operate the particular elements of casino gaming machines. Additionally, computing systems operating over networks, such as the Internet, also may include specialized components and/or functionality to operate elements particular to these systems, such as random number generators. An example of a representative computing system capable of carrying out operations in accordance with games 10 is illustrated in FIG. 25.

Hardware, firmware, software or a combination thereof may be used to perform the various gaming functions, display presentations and operations described herein. The functional modules used in connection with games 10 may reside in a gaming machine as described, or may alternatively reside on a stand-alone or networked computer. The computing structure 200 of FIG. 25 (also referred to as a computing arrangement and a computing device) is an example computing structure that may be used in connection with such electronic gaming machines, computers, or other computer-implemented devices to carry out operations of games 10. Although numerous components or elements are shown as part of this computing structure 200 in FIG. 25, additional or fewer components may be utilized in particular implementations of games 10.

The example computing arrangement 200 suitable for performing the gaming functions in accordance with games 10 typically includes a central processor (CPU) 202 coupled to random access memory (RAM) 204 and some variation of read-only memory (ROM) 206. Processor 202, either alone or together with one or more additional components of a computing arrangement, may be described as a controller. The ROM 206 also may represent other types of storage media to store programs, such as programmable ROM (PROM), erasable PROM (EPROM), etc. The processor 202 may communicate with other internal and external components through input/output (I/O) circuitry 208 and bussing 210, to provide control signals, communication signals, and the like.

The computing arrangement 200 also may include one or more data storage devices, including hard and floppy disk drives 212, CD-ROM drives 214, a card reader 215, and other hardware capable of reading and/or storing information such as DVDs, etc. In one embodiment, software for carrying out the operations in accordance with games 10 may be stored and distributed on a CD-ROM 216, diskette 218, or portable data storage 219, such as in the form of an access card, or other form of computer readable media capable of portably storing information. These storage media may be inserted into, and read by, devices such as the CD-ROM drive 214, the disk drive 212, card reader 215, etc. The software also may be transmitted to the computing arrangement 200 via data signals, such as being downloaded electronically via a network, such as a local area network (e.g., a casino, property, or bank network) or a wide area network (e.g., the Internet). Further, as previously described, the software for carrying out the functions associated with games 10 alternatively may be stored in internal memory/storage of the computing device 200, such as in the ROM 206.

The computing arrangement 200 is coupled to the display 211, which represents a display on which the gaming activities in accordance with games 10 are presented. The display 211 represents the "presentation" of the game information in accordance with games 10, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, such as a gaming apparatus 100, the display 211 corresponds to the game display 106 of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, or inputting data to identify a player for a player loyalty system. The display 211 also may act as a user input device, e.g., where the display 211 is a touchscreen device. In some embodiments, where the computing device 200 is implemented in a personal computer, tablet, smart phone, or other consumer electronic device, the user interface and display may be the available input/output mechanisms related to those devices.

Chance-based gaming systems such as slot machines, in which games 10 are applicable, are governed by random numbers and processors, as facilitated by a random number generator (RNG). The fixed and dynamic symbols generated as part of a gaming activity may be produced using one or more RNGs. RNGs may be implemented using hardware, software operable in connection with the processor 202, or some combination of hardware and software. Games 10 are operable using any known RNG, and may be integrally programmed as part of the processor 202 operation, or alternatively may use a separate RNG controller 240. The RNGs often are protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with games 10 and may interact with the player via one or more networks. The computing arrangement 200 also may be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 also may include a payout controller 242 configured to receive a signal from the processor 202 indicating a payout is to be made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 also may be provided in gaming machine embodiments, where the payout device 244 serves as the mechanism providing the payout to the player or participant. In some embodiments, the payout device may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency. In yet other embodiments, the payout device 244 may send a signal via the network server 228 or other device to electronically provide a credit amount to an account associated with the player, such as a credit card account or player loyalty account. The computing arrangement 200 also may include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 (also referred to as credit input 246) represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payout device 244 and payout controller 242 for independently determined payout events.

Among other functions, the computing arrangement 200 provides an interactive experience to players via an input interface 222 and output devices, such as the display 211, speaker 230, etc. These experiences generally are controlled by gaming software 232 that controls a primary gaming activity of the computing arrangement 200. The gaming software 232 may be temporarily loaded into RAM 204, and may be stored locally using any combination of ROM 206, drives 212, CD ROM drives 214, flash memory, or other non-transitory computer-readable storage media known in the art. The primary gaming software 232 also may be accessed remotely, such as via the server 228 or the Internet.

The primary gaming software 232 in the computing arrangement 200 may be an application software module. According to embodiments of games 10, this software 232 provides a slot game or similar game of chance as described hereinabove. For example, the software 232 may present, by way of the display 211, representations of symbols to map or otherwise display as part of a slot-based game having reels, such as games 10. However, in other embodiments, the principles of this concept may be applied to poker games or other types of games of chance. Symbols appearing in one or more predefined combinations of symbol positions may be evaluated to determine awards based on a paytable. The software 232 may include instructions to provide other functionality as known in the art or as described and shown herein.

Illustrative, non-exclusive examples of inventive subject matter according to the present disclosure are described in the following enumerated paragraphs:

A. A reel-based wagering game method implemented on a gaming apparatus comprising a game display, a user interface, and a controller, the reel-based wagering game method comprising:

(1) displaying, by the game display, changing reels;

(2) sequentially stopping, by the controller, at least a subset of the changing reels to display, by the game display, stopped reels, wherein each stopped reel comprises displayed game symbols;

(3) evaluating, by the controller, whether the displayed game symbols of the first X stopped reels correspond to a first payout condition, wherein X is an integer corresponding to a threshold number of reels to result in any payout condition;

(4) responsive to the displayed game symbols of the first X stopped reels corresponding to the first payout condition:

(4a) evaluating, by the controller, whether the displayed game symbols of the first X+1 stopped reels correspond to a second payout condition; and (4b) responsive to the displayed game symbols of the first X+1 stopped reels not corresponding to the second payout condition:

(4b1) displaying, by the game display, a bonus reel as a changing reel;

(4b2) stopping, by the controller, the bonus reel to display, by the game display, the bonus reel as a stopped reel; and (4b3) evaluating, by the controller, whether the displayed game symbols of the first X stopped reels and of the bonus reel correspond to a third payout condition.

A1. The reel-based wagering game method of paragraph A, wherein (4b1) displaying the bonus reel comprises:

displaying the bonus reel to the left of the first sequentially stopped reel in a left to right paying game; or displaying the bonus reel to the right of the first sequentially stopped reel in a right to left paying game.

A2. The reel-based wagering game method of any of paragraphs A-A1, wherein further (4b) responsive to the displayed game symbols of the first X+1 stopped reels not corresponding to the second payout condition:

(4b4) visually shifting, by the game display, displayed game reels such that:

the bonus reel visually shifts into a left-most column of a game grid in a left to right paying game; or the bonus reel visually shifts into a right-most column of the game grid in a right to left paying game.

A2.1. The reel-based wagering game of paragraph A2, wherein (4b4) visually shifting comprises visually displaying only portions of the left-most and the right-most reels that fit within the game grid.

A3. The reel-based wagering game method of any of paragraphs A-A2.1, wherein the bonus reel is an independent reel with a series of game symbols that does not correspond to other gaming reels of the reel-based wagering game method.

A4. The reel-based wagering game method of any of paragraphs A-A2.1, wherein the bonus reel has the same sequence of game symbols as the (X+1)th stopped reel.

A5. The reel-based wagering game method of any of paragraphs A-A2.1, wherein the bonus reel has the same sequence of game symbols as the left-most reel in a left to right paying game or as the right-most reel in a right to left paying game.

A6. The reel-based wagering game method of any of paragraphs A-A2.1, wherein the bonus reel has the same sequence of game symbols as the right-most reel in a left to right paying game or as the left-most reel in a right to left paying game.

A7. The reel-based wagering game method of any of paragraphs A-A6, wherein the bonus reel comprises a continuous sequence of identical game symbols.

A7.1. The reel-based wagering game method of paragraph A7, wherein the identical game symbols correspond to the third payout condition.

B. A reel-based wagering game method implemented on a gaming apparatus comprising a game display, a user interface, and a controller, the reel-based wagering game method comprising:

(1) displaying, by the game display, changing reels;

(2) sequentially stopping, by the controller, at least a subset of the changing reels to display, by the game display, stopped reels, wherein each stopped reel comprises displayed game symbols;

(3) evaluating, by the controller, whether the displayed game symbols of the first X−1 stopped reels lead to a first payout condition, wherein X is an integer corresponding to a threshold number of reels to result in any payout condition;

(4) responsive to the displayed game symbols of the first X−1 stopped reels leading to the first payout condition:

(4a) evaluating, by the controller, whether the displayed game symbols of the first X stopped reels correspond to the first payout condition; and (4b) responsive to the displayed game symbols of the first X stopped reels not corresponding to the first payout condition:

(4b1) displaying, by the game display, a bonus reel as a changing reel;

(4b2) stopping, by the controller, the bonus reel to display, by the game display, the bonus reel as a stopped reel; and (4b3) evaluating, by the controller, whether the displayed game symbols of the first X−1 stopped reels and of the bonus reel correspond to a second payout condition.

B1. The reel-based wagering game method of paragraph B, wherein (4b1) displaying the bonus reel comprises:

displaying the bonus reel to the left of the first sequentially stopped reel in a left to right paying game; or displaying the bonus reel to the right of the first sequentially stopped reel in a right to left paying game.

B2. The reel-based wagering game method of any of paragraphs B-B1, wherein further (4b) responsive to the displayed game symbols of the first X stopped reels not corresponding to the first payout condition:

(4b4) visually shifting, by the game display, displayed game reels such that:

the bonus reel visually shifts into a left-most column of a game grid in a left to right paying game; or the bonus reel visually shifts into a right-most column of the game grid in a right to left paying game.

B2.1. The reel-based wagering game of paragraph B2, wherein (4b4) visually shifting comprises visually displaying only portions of the left-most and the right-most reels that fit within the game grid.

B3. The reel-based wagering game method of any of paragraphs B-B2.1, wherein the bonus reel is an independent reel with a series of game symbols that does not correspond to other gaming reels of the reel-based wagering game method.

B4. The reel-based wagering game method of any of paragraphs B-B2.1, wherein the bonus reel has the same sequence of game symbols as the Xth stopped reel.

B5. The reel-based wagering game method of any of paragraphs B-B2.1, wherein the bonus reel has the same sequence of game symbols as the left-most reel in a left to right paying game or as the right-most reel in a right to left paying game.

B6. The reel-based wagering game method of any of paragraphs B-B2.1, wherein the bonus reel has the same sequence of game symbols as the right-most reel in a left to right paying game or as the left-most reel in a right to left paying game.

B7. The reel-based wagering game method of any of paragraphs B-B6, wherein the bonus reel comprises a continuous sequence of identical game symbols.

B7.1. The reel-based wagering game method of paragraph B7, wherein the identical game symbols correspond to the second payout condition.

C. A gaming apparatus configured to implement a reel-based wagering game, the gaming apparatus comprising:

a game display configured to display at least a portion of game reels of the reel-based wagering game;

a user interface configured to receive user input for controlling and engaging with the reel-based wagering game;

a wager input device structured to receive physical currency or currency based structure, the currency or currency based structure establishing a credit balance, the credit balance being increasable and decreasable based at least on wagering activity received from a player via the user interface;

a cashout device configured to receive an input to cause an initiation of a payout associated with the credit balance; and a controller operably coupled to the game display, the user interface, the wager input device, and the cashout device, wherein the controller is operable to:

(1) responsive at least to initiation of a play, cause the game display to display the game reels as changing reels;

(2) cause the game display to sequentially stop the changing reels to display stopped reels, wherein each stopped reel comprises displayed game symbols;

(3) evaluate whether the displayed game symbols of the first X stopped reels correspond to a first payout condition, wherein X is an integer corresponding to a threshold number of reels to result in any payout condition;

(4) responsive to the displayed game symbols of the first X stopped reels corresponding to the first payout condition:

(4a) evaluate whether the displayed game symbols of the first X+1 stopped reels correspond to a second payout condition; and (4b) responsive to the displayed game symbols of the first X+1 stopped reels not corresponding to the second payout condition:

(4b1) cause the game display to display a bonus reel as a changing reel;

(4b2) cause the game display to display the bonus reel as a stopped reel; and (4b3) evaluate whether the displayed game symbols of the first X stopped reels and of the bonus reel correspond to a third payout condition.

C1. The gaming apparatus of paragraph C, wherein (4b1) comprises:

cause the game display to display the bonus reel to the left of the first sequentially stopped reel in a left to right paying game; or cause the game display to display the bonus reel to the right of the first sequentially stopped reel in a right to left paying game.

C2. The gaming apparatus of any of paragraphs C-C1, wherein further (4b) responsive to the displayed game symbols of the first X+1 stopped reels not corresponding to the second payout condition:

(4b4) cause the game display to visually shift displayed game reels such that:

the bonus reel visually shifts into a left-most column of a game grid in a left to right paying game; or the bonus reel visually shifts into a right-most column of the game grid in a right to left paying game.

C2.1. The gaming apparatus of paragraph C2, wherein (4b4) comprises during the visually shifting, cause the game display to visually display only portions of the left-most and the right-most reels that fit within the game grid.

C3. The gaming apparatus of any of paragraphs C-C2.1, wherein the bonus reel is an independent reel with a series of game symbols that does not correspond to other gaming reels of the reel-based wagering game.

C4. The gaming apparatus of any of paragraphs C-C2.1, wherein the bonus reel has the same sequence of game symbols as the (X+1)th stopped reel.

C5. The gaming apparatus of any of paragraphs C-C2.1, wherein the bonus reel has the same sequence of game symbols as the left-most reel in a left to right paying game or as the right-most reel in a right to left paying game.

C6. The gaming apparatus of any of paragraphs C-C2.1, wherein the bonus reel has the same sequence of game symbols as the right-most reel in a left to right paying game or as the left-most reel in a right to left paying game.

C7. The gaming apparatus of any of paragraphs C-C6, wherein the bonus reel comprises a continuous sequence of identical game symbols.

C7.1. The gaming apparatus of paragraph C7, wherein the identical game symbols correspond to the third payout condition.

C8. The gaming apparatus of any of paragraphs C-C7.1, wherein the gaming apparatus is configured to perform the reel-based wagering game method of any of paragraphs A-A7.1.

D. A gaming apparatus configured to implement a reel-based wagering game, the gaming apparatus comprising:

a game display configured to display at least a portion of game reels of the reel-based wagering game;

a user interface configured to receive user input for controlling and engaging with the reel-based wagering game;

a wager input device structured to receive physical currency or currency based structure, the currency or currency based structure establishing a credit balance, the credit balance being increasable and decreasable based at least on wagering activity received from a player via the user interface;

a cashout device configured to receive an input to cause an initiation of a payout associated with the credit balance; and a controller operably coupled to the game display, the user interface, the wager input device, and the cashout device, wherein the controller is operable to:

(1) responsive at least to initiation of a play, cause the game display to display the game reels as changing reels;

(2) cause the game display to sequentially stop the changing reels to display stopped reels, wherein each stopped reel comprises displayed game symbols;

(3) evaluate whether the displayed game symbols of the first X−1 stopped reels lead to a first payout condition, wherein X is an integer corresponding to a threshold number of reels to result in any payout condition;

(4) responsive to the displayed game symbols of the first X−1 stopped reels leading to the first payout condition:

(4a) evaluate whether the displayed game symbols of the first X stopped reels correspond to the first payout condition; and (4b) responsive to the displayed game symbols of the first X stopped reels not corresponding to the first payout condition:

(4b1) cause the game display to display a bonus reel as a changing reel;

(4b2) cause the game display top display the bonus reel as a stopped reel; and (4b3) evaluate whether the displayed game symbols of the first X−1 stopped reels and of the bonus reel correspond to a second payout condition.

D1. The gaming apparatus of paragraph D, wherein (4b1) comprises: cause the game display to display the bonus reel to the left of the first sequentially stopped reel in a left to right paying game; or cause the game display to display the bonus reel to the right of the first sequentially stopped reel in a right to left paying game.

D2. The gaming apparatus of any of paragraphs D-D1, wherein further (4b) responsive to the displayed game symbols of the first X stopped reels not corresponding to the first payout condition:

(4b4) cause the game display to visually shift displayed game reels such that:

the bonus reel visually shifts into a left-most column of a game grid in a left to right paying game; or the bonus reel visually shifts into a right-most column of the game grid in a right to left paying game.

D2.1. The gaming apparatus of paragraph D2, wherein (4b4) comprises during the visually shifting, cause the game display to visually display only portions of the left-most and the right-most reels that fit within the game grid.

D3. The gaming apparatus of any of paragraphs D-D2.1, wherein the bonus reel is an independent reel with a series of game symbols that does not correspond to other gaming reels of the reel-based wagering game.

D4. The gaming apparatus of any of paragraphs D-D2.1, wherein the bonus reel has the same sequence of game symbols as the Xth stopped reel.

D5. The gaming apparatus of any of paragraphs D-D2.1, wherein the bonus reel has the same sequence of game symbols as the left-most reel in a left to right paying game or as the right-most reel in a right to left paying game.

D6. The gaming apparatus of any of paragraphs D-D2.1, wherein the bonus reel has the same sequence of game symbols as the right-most reel in a left to right paying game or as the left-most reel in a right to left paying game.

D7. The gaming apparatus of any of paragraphs D-D6, wherein the bonus reel comprises a continuous sequence of identical game symbols.

D7.1. The gaming apparatus of paragraph D7, wherein the identical game symbols correspond to the second payout condition.

D8. The gaming apparatus of any of paragraphs D-D7.1, wherein the gaming apparatus is configured to perform the reel-based wagering game method of any of paragraphs B-B7.1.

E. A reel-based wagering game method implemented on a gaming apparatus comprising a game display, a user interface, and a controller, the reel-based wagering game method comprising:

(1) displaying, on the game display, a number of game reels;

(2) evaluating, by the controller, payout conditions associated with the number of game reels;

(3) based on evaluation of the payout conditions, displaying, on the game display, a bonus reel; and (4) evaluating, by the controller, payout conditions associated with the number of game reels and the bonus reel.

E1. The reel-based wagering game method of paragraph E, wherein (3) comprises:

displaying the bonus reel as a left-most reel in a left to right paying game; or displaying the bonus reel as a right-most reel in a right to left paying game.

E2. The reel-based wagering game method of any of paragraphs E-E1, wherein (3) comprises:

visually shifting the bonus reel into a left-most column of a game grid in a left to right paying game; or visually shifting the bonus reel into a right-most column of the game grid in a right to left paying game.

E2.1. The reel-based wagering game method of paragraph E2, wherein (3) comprises during the visually shifting, visually displaying only portions of the left-most and the right-most reels that fit within the game grid.

E3. The reel-based wagering game method of any of paragraphs E-E2.1, wherein the bonus reel is an independent reel with a series of game symbols that does not correspond to other gaming reels of the reel-based wagering game method.

E4. The reel-based wagering game method of any of paragraphs E-E2.1, wherein the bonus reel has the same sequence of game symbols as the reel that triggered the bonus reel.

E5. The reel-based wagering game method of any of paragraphs E-E2.1, wherein the bonus reel has the same sequence of game symbols as the left-most reel in a left to right paying game or as the right-most reel in a right to left paying game.

E6. The reel-based wagering game method of any of paragraphs E-E2.1, wherein the bonus reel has the same sequence of game symbols as the right-most reel in a left to right paying game or as the left-most reel in a right to left paying game.

E7. The reel-based wagering game method of any of paragraphs E-E6, wherein the bonus reel comprises a continuous sequence of identical game symbols.

E7.1. The reel-based wagering game method of paragraph E7, wherein the identical game symbols correspond to a payout condition associated with the bonus reel.

E8. The reel-based wagering game method of any of paragraphs E-E7.1, further comprising any suitable subject matter of any of paragraphs A-D8.

F. A gaming apparatus configured to implement a reel-based wagering game, the gaming apparatus comprising:

a game display; and a controller programmed to:

(1) display, on the game display, a number of game reels;

(2) evaluate payout conditions associated with the number of game reels;

(3) based on evaluation of the payout conditions, display, on the game display, a bonus reel; and (4) evaluate payout conditions associated with the number of game reels and the bonus reel.

F1. The gaming apparatus of paragraph F, wherein (3) comprises:

display the bonus reel as a left-most reel in a left to right paying game; or display the bonus reel as a right-most reel in a right to left paying game.

F2. The gaming apparatus of any of paragraphs F-F1, wherein (3) comprises:

visually shift the bonus reel into a left-most column of a game grid in a left to right paying game; or visually shift the bonus reel into a right-most column of the game grid in a right to left paying game.

F2.1. The gaming apparatus of paragraph F2, wherein (3) comprises during the visually shifting, visually display only portions of the left-most and the right-most reels that fit within the game grid.

F3. The gaming apparatus of any of paragraphs F-F2.1, wherein the bonus reel is an independent reel with a series of game symbols that does not correspond to other gaming reels of the reel-based wagering game method.

F4. The gaming apparatus of any of paragraphs F-F2.1, wherein the bonus reel has the same sequence of game symbols as the reel that triggered the bonus reel.

F5. The gaming apparatus of any of paragraphs F-F2.1, wherein the bonus reel has the same sequence of game symbols as the left-most reel in a left to right paying game or as the right-most reel in a right to left paying game.

F6. The gaming apparatus of any of paragraphs F-F2.1, wherein the bonus reel has the same sequence of game symbols as the right-most reel in a left to right paying game or as the left-most reel in a right to left paying game.

F7. The gaming apparatus of any of paragraphs F-F6, wherein the bonus reel comprises a continuous sequence of identical game symbols.

F7.1. The gaming apparatus of paragraph F7, wherein the identical game symbols correspond to a payout condition associated with the bonus reel.

F8. The gaming apparatus of any of paragraphs F-F7.1, further comprising:

a wager input device structured to receive wagering activity from a player; and wherein the controller is further configured to increase and decrease a credit balance based on the wagering activity and based on payouts resulting from evaluations of the payout conditions.

F9. The gaming apparatus of any of paragraphs F-F8, further comprising any suitable subject matter of any of paragraphs A-E8.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A reel-based wagering game method implemented on a gaming apparatus comprising a game display, a user interface, and a controller, the reel-based wagering game method comprising:

(1) displaying, by the game display, changing reels;

(2) sequentially stopping, by the controller, at least a subset of the changing reels to display, by the game display, stopped reels, wherein each stopped reel comprises displayed game symbols;

(3) evaluating, by the controller, whether the displayed game symbols of the first X stopped reels correspond to a first payout condition, wherein X is an integer corresponding to a threshold number of reels to result in any payout condition;

(4) responsive to the displayed game symbols of the first X stopped reels corresponding to the first payout condition:

(4a) evaluating, by the controller, whether the displayed game symbols of the first X+1 stopped reels correspond to a second payout condition; and (4b) responsive to the displayed game symbols of the first X+1 stopped reels not corresponding to the second payout condition:

(4b1) displaying, by the game display, a bonus reel as a changing reel;

(4b2) stopping, by the controller, the bonus reel to display, by the game display, the bonus reel as a stopped reel; and (4b3) evaluating, by the controller, whether the displayed game symbols of the first X stopped reels and of the bonus reel correspond to a third payout condition.

2. The reel-based wagering game method of claim 1, wherein (4b1) displaying the bonus reel comprises:

displaying the bonus reel to the left of the first sequentially stopped reel in a left to right paying game; or displaying the bonus reel to the right of the first sequentially stopped reel in a right to left paying game.

3. The reel-based wagering game method of claim 1, wherein further (4b) responsive to the displayed game symbols of the first X+1 stopped reels not corresponding to the second payout condition:

(4b4) visually shifting, by the game display, displayed game reels such that:

the bonus reel visually shifts into a left-most column of a game grid in a left to right paying game; or the bonus reel visually shifts into a right-most column of the game grid in a right to left paying game.

4. The reel-based wagering game of claim 3, wherein (4b4) visually shifting comprises during the visually shifting, visually displaying only portions of the left-most and the right-most reels that fit within the game grid.

5. The reel-based wagering game method of claim 1, wherein the bonus reel is an independent reel with a series of game symbols that does not correspond to other gaming reels of the reel-based wagering game method.

6. The reel-based wagering game method of claim 1, wherein the bonus reel has the same sequence of game symbols as the (X+1)th stopped reel.

7. The reel-based wagering game method of claim 1, wherein the bonus reel has the same sequence of game symbols as the left-most reel in a left to right paying game or as the right-most reel in a right to left paying game.

8. The reel-based wagering game method of claim 1, wherein the bonus reel has the same sequence of game symbols as the right-most reel in a left to right paying game or as the left-most reel in a right to left paying game.

9. The reel-based wagering game method of claim 1, wherein the bonus reel comprises a continuous sequence of identical game symbols.

10. The reel-based wagering game method of claim 9, wherein the identical game symbols correspond to the third payout condition.

11. A reel-based wagering game method implemented on a gaming apparatus comprising a game display, a user interface, and a controller, the reel-based wagering game method comprising:

(1) displaying, by the game display, changing reels;

(2) sequentially stopping, by the controller, at least a subset of the changing reels to display, by the game display, stopped reels, wherein each stopped reel comprises displayed game symbols;

(3) evaluating, by the controller, whether the displayed game symbols of the first X−1 stopped reels lead to a first payout condition, wherein X is an integer corresponding to a threshold number of reels to result in any payout condition;

(4) responsive to the displayed game symbols of the first X−1 stopped reels leading to the first payout condition:

(4a) evaluating, by the controller, whether the displayed game symbols of the first X stopped reels correspond to the first payout condition; and (4b) responsive to the displayed game symbols of the first X stopped reels not corresponding to the first payout condition:

(4b1) displaying, by the game display, a bonus reel as a changing reel;

(4b2) stopping, by the controller, the bonus reel to display, by the game display, the bonus reel as a stopped reel; and (4b3) evaluating, by the controller, whether the displayed game symbols of the first X−1 stopped reels and of the bonus reel correspond to a second payout condition.

12. A gaming apparatus configured to implement a reel-based wagering game, the gaming apparatus comprising:

a game display configured to display at least a portion of game reels of the reel-based wagering game;

a user interface configured to receive user input for controlling and engaging with the reel-based wagering game;

a wager input device structured to receive physical currency or currency based structure, the currency or currency based structure establishing a credit balance, the credit balance being increasable and decreasable based at least on wagering activity received from a player via the user interface;

a cashout device configured to receive an input to cause an initiation of a payout associated with the credit balance; and a controller operably coupled to the game display, the user interface, the wager input device, and the cashout device, wherein the controller is operable to:

(1) responsive at least to initiation of a play, cause the game display to display the game reels as changing reels;

(2) cause the game display to sequentially stop the changing reels to display stopped reels, wherein each stopped reel comprises displayed game symbols;

(3) evaluate whether the displayed game symbols of the first X stopped reels correspond to a first payout condition, wherein X is an integer corresponding to a threshold number of reels to result in any payout condition;

(4) responsive to the displayed game symbols of the first X stopped reels corresponding to the first payout condition:

(4a) evaluate whether the displayed game symbols of the first X+1 stopped reels correspond to a second payout condition; and (4b) responsive to the displayed game symbols of the first X+1 stopped reels not corresponding to the second payout condition:

(4b1) cause the game display to display a bonus reel as a changing reel;

(4b2) cause the game display to display the bonus reel as a stopped reel; and (4b3) evaluate whether the displayed game symbols of the first X stopped reels and of the bonus reel correspond to a third payout condition.

13. A reel-based wagering game method implemented on a gaming apparatus comprising a game display, a user interface, and a controller, the reel-based wagering game method comprising:

(1) displaying, on the game display, a number of game reels;

(2) evaluating, by the controller, payout conditions associated with the number of game reels;

(3) based on evaluation of the payout conditions, displaying, on the game display, a bonus reel by visually shifting the bonus reel (i) into a left-most column of a game grid in a left to right paying game or (ii) into a right-most column of the game grid in a right to left paying game; and (4) evaluating, by the controller, payout conditions associated with the number of game reels and the bonus reel.

14. The reel-based wagering game method of claim 13, wherein (3) comprises during the visually shifting, visually displaying only portions of the left-most and the right-most reels that fit within the game grid.

15. The reel-based wagering game method of claim 13, wherein the bonus reel is an independent reel with a series of game symbols that does not correspond to other gaming reels of the reel-based wagering game method.

16. The reel-based wagering game method of claim 13, wherein the bonus reel has the same sequence of game symbols as the reel that triggered the bonus reel.

17. The reel-based wagering game method of claim 13, wherein the bonus reel has the same sequence of game symbols as the left-most reel in a left to right paying game or as the right-most reel in a right to left paying game.

18. The reel-based wagering game method of claim 13, wherein the bonus reel has the same sequence of game symbols as the right-most reel in a left to right paying game or as the left-most reel in a right to left paying game.

19. The reel-based wagering game method of claim 13, wherein the bonus reel comprises a continuous sequence of identical game symbols.

20. The reel-based wagering game method of claim 19, wherein the identical game symbols correspond to a payout condition associated with the bonus reel.

* * * * *